US012693023B2

(12) United States Patent
Iwamoto et al.

(10) Patent No.: US 12,693,023 B2
(45) Date of Patent: Jul. 28, 2026

(54) HEATING COOKING APPARATUS

(71) Applicant: SHARP KABUSHIKI KAISHA, Sakai City (JP)

(72) Inventors: Masayuki Iwamoto, Sakai City (JP); Shinji Asami, Sakai City (JP); Hiromi Suenaga, Sakai City (JP); Masahiro Nishijima, Sakai City (JP); Tomohiro Kitaura, Sakai City (JP); Yu Shinohara, Sakai City (JP); Tsuyoshi Ootani, Sakai City (JP)

(73) Assignee: SHARP KABUSHIKI KAISHA, Sakai City (JP)

( * ) Notice: Subject to any disclaimer, the term of this patent is extended or adjusted under 35 U.S.C. 154(b) by 570 days.

(21) Appl. No.: 17/791,441

(22) PCT Filed: Jan. 7, 2021

(86) PCT No.: PCT/JP2021/000350
§ 371 (c)(1),
(2) Date: Jul. 7, 2022

(87) PCT Pub. No.: WO2021/141080
PCT Pub. Date: Jul. 15, 2021

(65) Prior Publication Data

US 2023/0048380 A1 Feb. 16, 2023

(30) Foreign Application Priority Data

Jan. 9, 2020 (JP) ..... 2020-002249

(51) Int. Cl.
*F24C 15/04* (2006.01)
*F24C 15/00* (2006.01)
(Continued)

(52) U.S. Cl.
CPC ..... *F24C 15/04* (2013.01); *F24C 15/006* (2013.01); *F24C 15/34* (2013.01)

(58) Field of Classification Search
CPC ..... F24C 15/006; F24C 15/04; A12B 3/02
(Continued)

(56) References Cited

U.S. PATENT DOCUMENTS 3,192,575 A * 7/1965 Rosenau, Jr. ..... C03C 17/06 359/360
3,370,155 A * 2/1968 Belliveau ..... G01N 3/18 219/406
(Continued)

FOREIGN PATENT DOCUMENTS

CN 678913 A5 * 11/1991 ..... F24C 15/04
DE 9114710 U1 * 1/1992
(Continued)

*Primary Examiner* — Michael G Hoang
*Assistant Examiner* — Logan P Jones
(74) *Attorney, Agent, or Firm* — ScienBiziP, P.C.

(57) ABSTRACT

A heating cooking apparatus (1) includes a heating cooking chamber (10), a lid portion (20), and heat supply units (31), (32), and (34). The heating cooking chamber (10) includes an accommodation space 1A and an opening 11A. The opening 11A communicates with the accommodation space 1A. The lid portion (20) is configured to close the opening 11A. The lid portion (20) includes a see-through window portion (21). The see-through window portion (21) makes the accommodation space 1A visible. The see-through window portion (21) includes at least three glass plates (210). The at least three glass plates (210) include a heat-ray reflecting glass (212) that reflects heat rays, a first glass plate (213) located proximate to the accommodation space 1A, and a second glass plate (211) located opposite to the accommodation space 1A. The heat-ray reflecting glass (212) is located between a first glass plate (213) and a second glass plate (211). The first glass plate (213), the
(Continued)

heat-ray reflecting glass (212), and the second glass plate (211) are arranged side by side in a line at intervals.

8 Claims, 19 Drawing Sheets

(51) Int. Cl.
*F24C 15/16* (2006.01)
*F24C 15/34* (2006.01)
*H05B 6/64* (2006.01)

(58) Field of Classification Search
USPC ..... 126/200, 193, 190
See application file for complete search history.

(56) References Cited

U.S. PATENT DOCUMENTS 3,612,825 A * 10/1971 Chase ..... F24C 14/02 219/400
4,207,863 A 6/1980 Drouin
5,441,036 A 8/1995 Mikalauskas, II
7,431,029 B2 * 10/2008 Kim ..... F24C 15/04 126/193
8,253,084 B2 8/2012 Toyoda et al.
8,461,488 B2 * 6/2013 Jeong ..... F24C 15/325 219/400
8,857,422 B2 * 10/2014 Elkasevic ..... F24C 15/04 126/190
2005/0127060 A1 * 6/2005 Kim ..... F24C 15/325 219/400
2008/0105140 A1 * 5/2008 Lee ..... H05B 6/642 99/468
2010/0133263 A1 6/2010 Toyoda et al.
2012/0187115 A1 7/2012 Toyoda et al.
2012/0192725 A1 8/2012 Toyoda et al.
2016/0033142 A1 * 2/2016 Oh ..... F24C 15/028 126/200
2017/0171921 A1 * 6/2017 Nasu ..... H05B 6/6414
2017/0311394 A1 * 10/2017 Shibuya ..... A47J 27/04
2019/0063130 A1 * 2/2019 Oh ..... F24C 15/023

FOREIGN PATENT DOCUMENTS

DE 10349313 A1 * 5/2005 ..... F24C 15/006
EP 2090832 A1 8/2009
FR 2788841 A1 * 7/2000 ..... F24C 15/006
JP S52112842 A 9/1977
JP 108-152140 A 6/1996
JP 2005-245629 A 9/2005
JP 2005-249218 A 9/2005
JP 2009204180 A 9/2009
JP 2010-133634 A 6/2010
JP 2015152228 A 8/2015
JP 6178159 B2 8/2017
KR 20190001911 A * 1/2019 ..... F24C 15/04
NO 770418 L * 8/1977 ..... H05B 6/642
WO WO-2008032897 A1 * 3/2008 ..... F24C 15/006

* cited by examiner

HEATING COOKING APPARATUS

TECHNICAL FIELD

The present invention relates to a heating cooking apparatus.

BACKGROUND ART

Heating cooking apparatuses are known. A heating cooking apparatus includes a heating cooking chamber and a pull-out body. The heating cooking chamber includes an accommodation space. The pull-out body is integrated with an opening/closing door. The opening/closing door can close the accommodation space. The pull-out body is disposed to be able to be pulled out relative to the heating cooking chamber. Such a heating cooking apparatus as described above is built into a cabinet of a built-in kitchen.

PTL 1 discloses a heating cooking apparatus. Heating functions of the heating cooking apparatus disclosed in PTL 1 include a microwave heating function and a high-speed hot air heating function. The microwave heating function is a function of irradiating an object to be heated with microwaves. The high-speed hot air heating function is a function of blowing out hot air toward an object to be heated at high speed.

CITATION LIST

Patent Literature

PTL 1: JP 2010-133634 A

SUMMARY OF INVENTION

Technical Problem

Unfortunately, in the heating cooking apparatus disclosed in PTL 1, in a case where the high-speed hot air heating function is used, the temperature of the surface (the temperature of the outer surface) of an opening/closing door (lid portion) may rise with a rise in the temperature inside the heating cooking chamber.

In light of the above problem, an object of the present invention is to provide a heating cooking apparatus that can reduce a rise in the temperature of an outer surface of a lid portion.

Solution to Problem

A heating cooking apparatus of the present invention includes a heating cooking chamber, a lid portion, and a heat supply unit. The heating cooking chamber includes an accommodation space and an opening. The accommodation space accommodates an object to be heated. The opening communicates with the accommodation space. The lid portion is configured to close the opening. The heat supply unit supplies heat into the accommodation space. The lid portion includes a see-through window portion. The see-through window portion makes the accommodation space visible. The see-through window portion includes at least three glass plates. The at least three glass plate include a heat-ray reflecting glass, a first glass plate, and a second glass plate. The heat-ray reflecting glass reflects heat rays. The first glass plate is located proximate to the accommodation space. The second glass plate is located opposite to the accommodation space. The heat-ray reflecting glass is located between the first glass plate and the second glass plate. The first glass plate, the heat-ray reflecting glass, and the second glass plate are arranged side by side in a line at intervals.

Advantageous Effects of Invention

According to a heating cooking apparatus of the present invention, it is possible to reduce a rise in the temperature of an outer surface of a lid portion.

DESCRIPTION OF EMBODIMENTS

Figure 1:
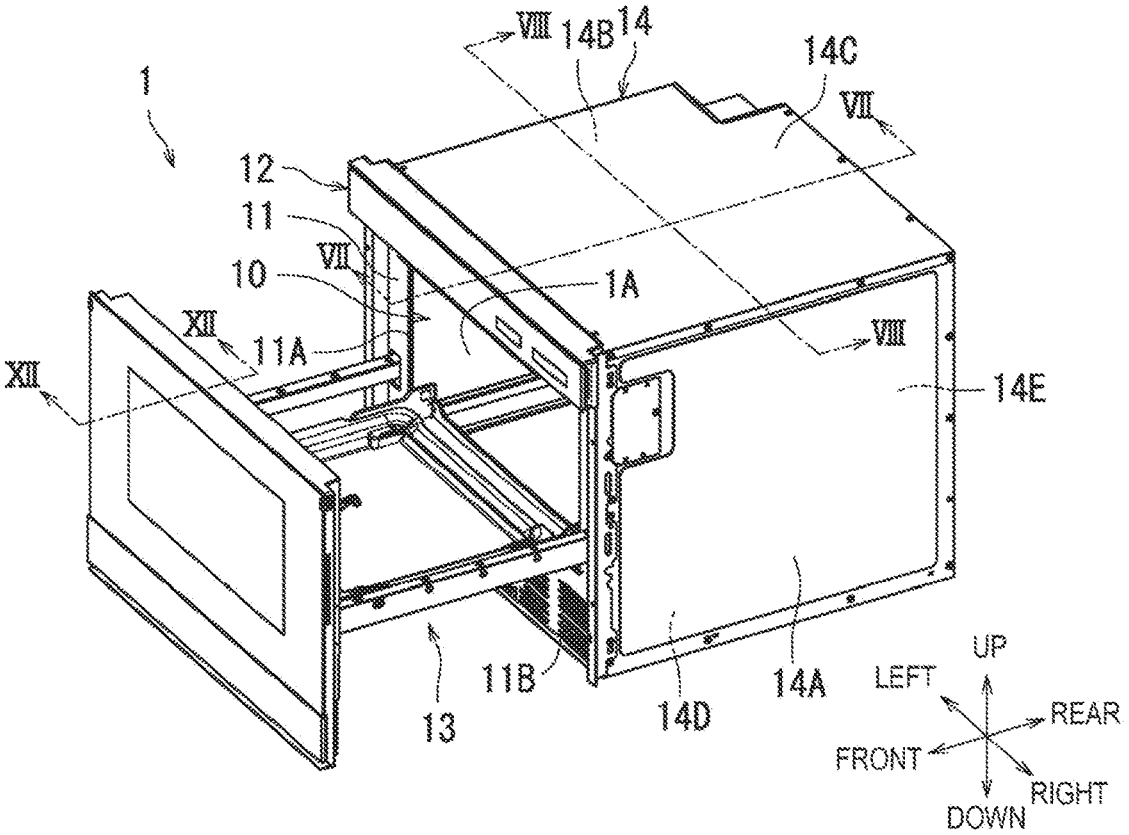
FIG. 1 is a perspective view of a heating cooking apparatus according to an embodiment of the present invention.

An embodiment of a heating cooking apparatus according to the present invention will be described below with reference to the drawings. Note that, in the drawings, the same or equivalent components are denoted by the same reference numerals and signs, and description thereof will not be repeated.

Figure 2:
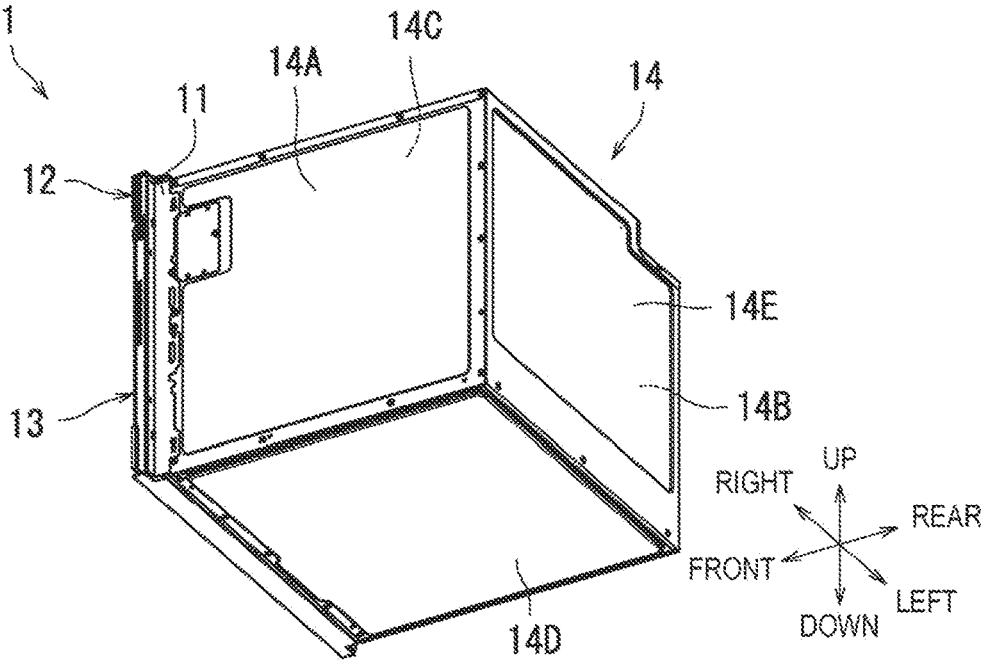
FIG. 2 is a perspective view of a heating cooking apparatus according to the embodiment of the present invention.

With reference to FIG. 1 and FIG. 2, a heating cooking apparatus 1 according to the present embodiment will be described. FIG. 1 and FIG. 2 are perspective views of the heating cooking apparatus 1 according to the present embodiment. More specifically, FIG. 1 illustrates the heating cooking apparatus 1 in an upper right diagonal direction from the front. FIG. 2 illustrates the heating cooking apparatus 1 in a lower right diagonal direction from behind.

The heating cooking apparatus 1 is used to heat and cook an object to be heated. The object to be heated is, for example, food. As illustrated in FIG. 1, the heating cooking apparatus 1 includes a heating cooking chamber 10, an operation panel unit 12, a pull-out body 13, and a housing 14.

In the present embodiment, a side on which the operation panel unit 12 of the heating cooking apparatus 1 is disposed is defined as a front side, and a side opposite thereto is defined as a rear side. Further, a right side as viewed from the front side of the heating cooking apparatus 1 is defined as a right side, and a side opposite thereto is defined as a left side. Further, a side on which the operation panel unit 12 is disposed in a direction orthogonal to a front-rear direction and a left-right direction of the heating cooking apparatus 1 is defined as an upper side, and a side opposite thereto is defined as a lower side. Note that these directions are not intended to limit the directions of the heating cooking apparatus according to the present invention when the heating cooking apparatus is used.

The heating cooking chamber 10 has a box shape. The heating cooking chamber 10 internally includes an accommodation space 1A. The accommodation space 1A accommodates an object to be heated.

In the present embodiment, the heating cooking apparatus 1 includes, as heating cooking modes, a microwave heating mode, a first hot air circulation heating mode, a second hot air circulation heating mode, and a grill heating mode. The microwave heating mode is mainly a mode in which an object to be heated is heated and cooked through radiation of microwaves into the accommodation space 1A. The first hot air circulation heating mode is mainly a mode in which an object to be heated is heated and cooked by circulating first hot air H1 in the accommodation space 1A. The second hot air circulation heating mode mainly includes a first mode and a second mode. The first mode is a mode in which an object to be heated is heated and cooked by directly blowing second hot air H2 onto an upper surface of the object to be heated. The second mode is a mode in which the accommodation space 1A is preheated in a short time by circulating the second hot air H2 in the accommodation space 1A. The grill heating mode is mainly a mode in which an object to be heated is heated and cooked by exposing the object to be heated to heat radiation.

The heating cooking chamber 10 includes a panel 11. The panel 11 is disposed on the front side of the heating cooking chamber 10. The panel 11 includes an opening 11A. The opening 11A is located at a substantially center portion of the panel 11. The opening 11A has a rectangular shape. The opening 11A communicates with the accommodation space 1A. Details of the panel 11 will be described below with reference to FIG. 6.

The operation panel unit 12 receives operation from a user. The operation panel unit 12 is disposed further forward than the panel 11. In other words, the operation panel unit 12 is disposed in front of the heating cooking chamber 10. The operation panel unit 12 is located at an upper portion of the heating cooking apparatus 1.

The pull-out body 13 can be pulled out freely relative to the accommodation space 1A in a pull-out direction. More specifically, the pull-out body 13 is pulled out in the front direction of the heating cooking chamber 10. The pull-out body 13 is located below the operation panel unit 12. Details of the configuration of the pull-out body 13 will be described below with reference to FIG. 3 and FIG. 4. The pull-out direction is substantially parallel to a front-rear direction.

The housing 14 accommodates the heating cooking chamber 10. The housing 14 is an object having a rectangular parallelepiped shape with an open front side. As illustrated in FIG. 2, the housing 14 includes a right wall 14A, a left wall 14B, an upper wall 14C, a lower wall 14D, and a rear wall 14E.

Figure 3:
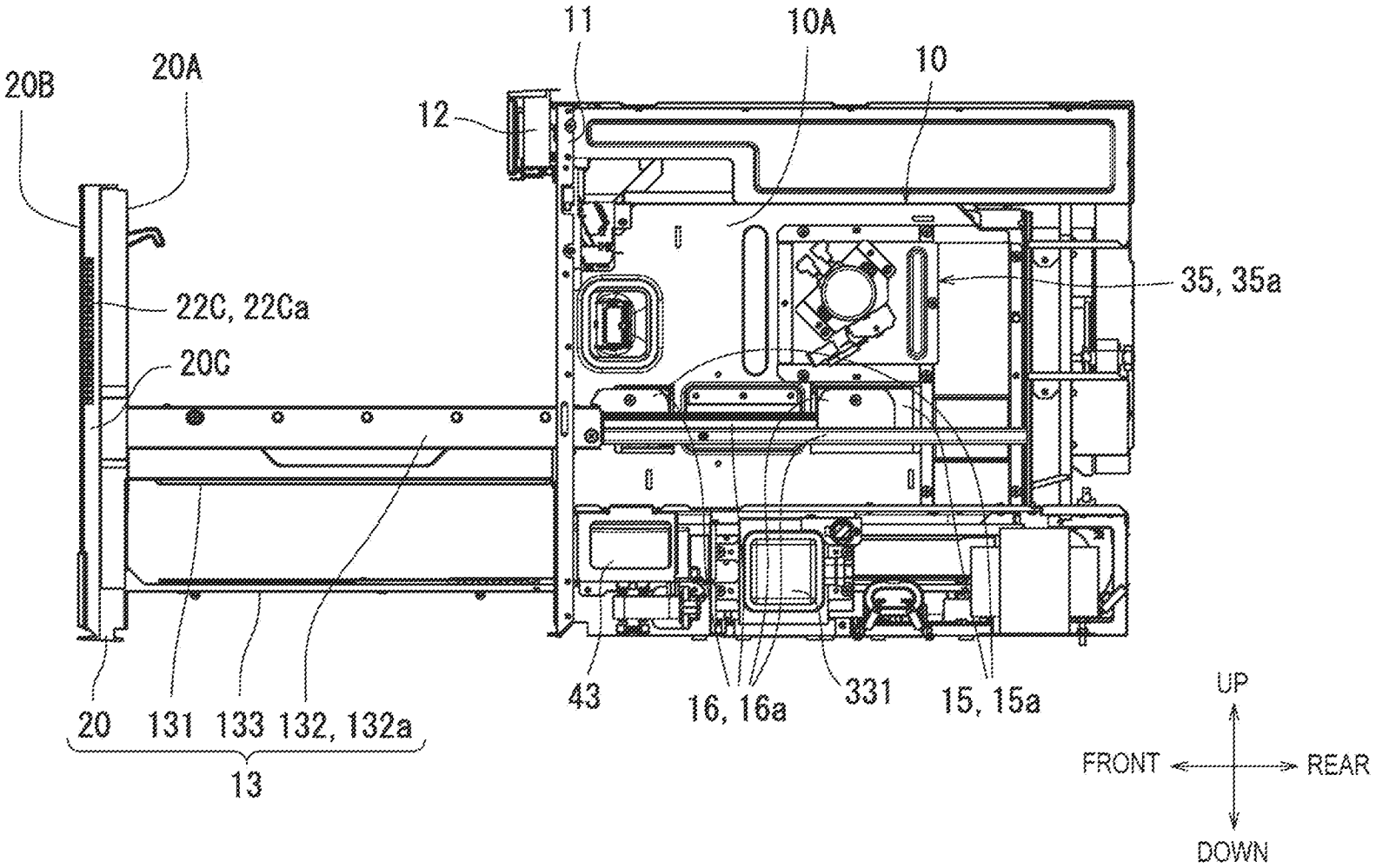
FIG. 3 is a diagram illustrating a right side surface of the heating cooking apparatus according to the embodiment of the present invention.
Figure 4:
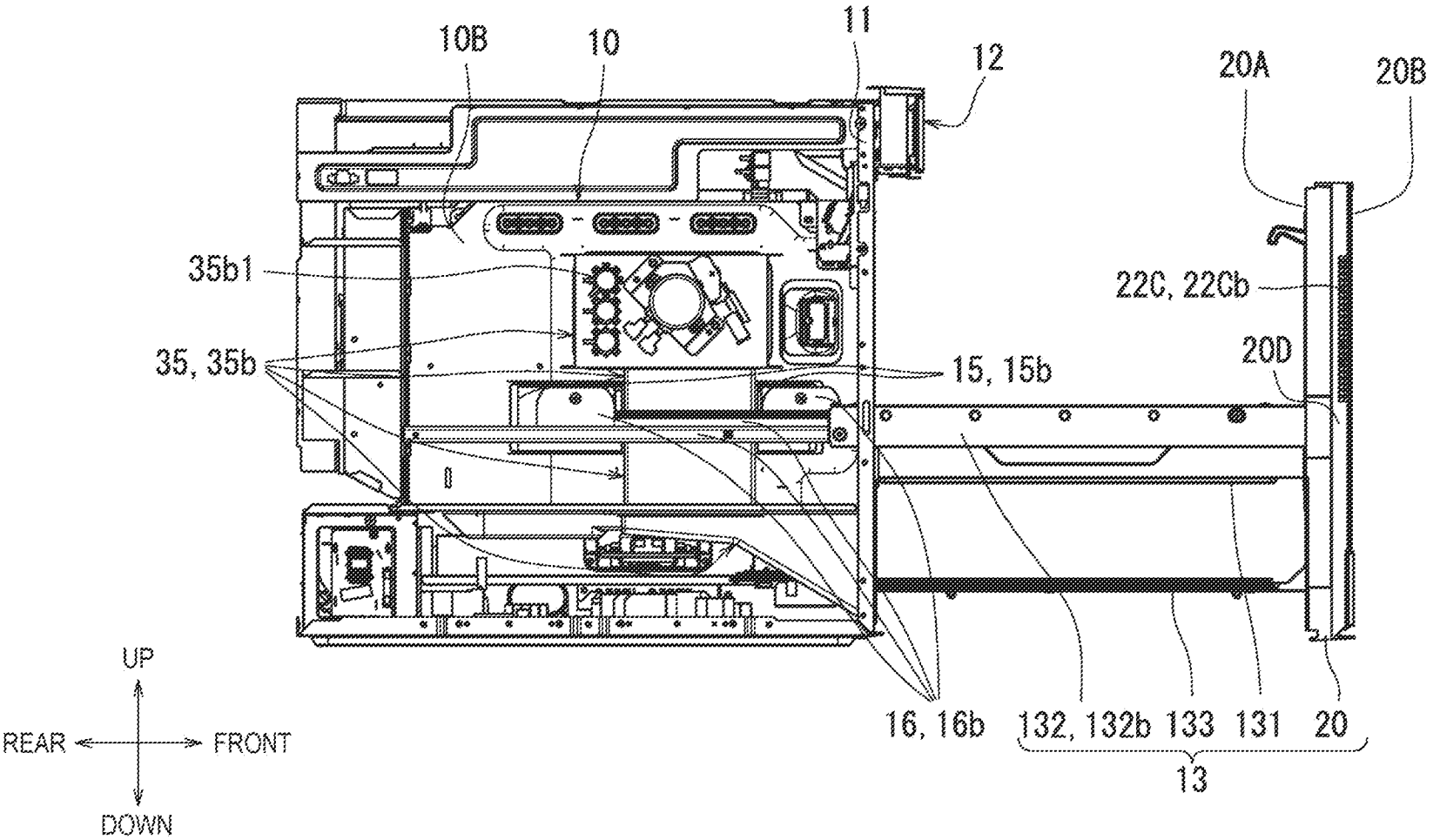
FIG. 4 is a diagram illustrating a left side surface of the heating cooking apparatus according to the embodiment of the present invention.
Figure 5:
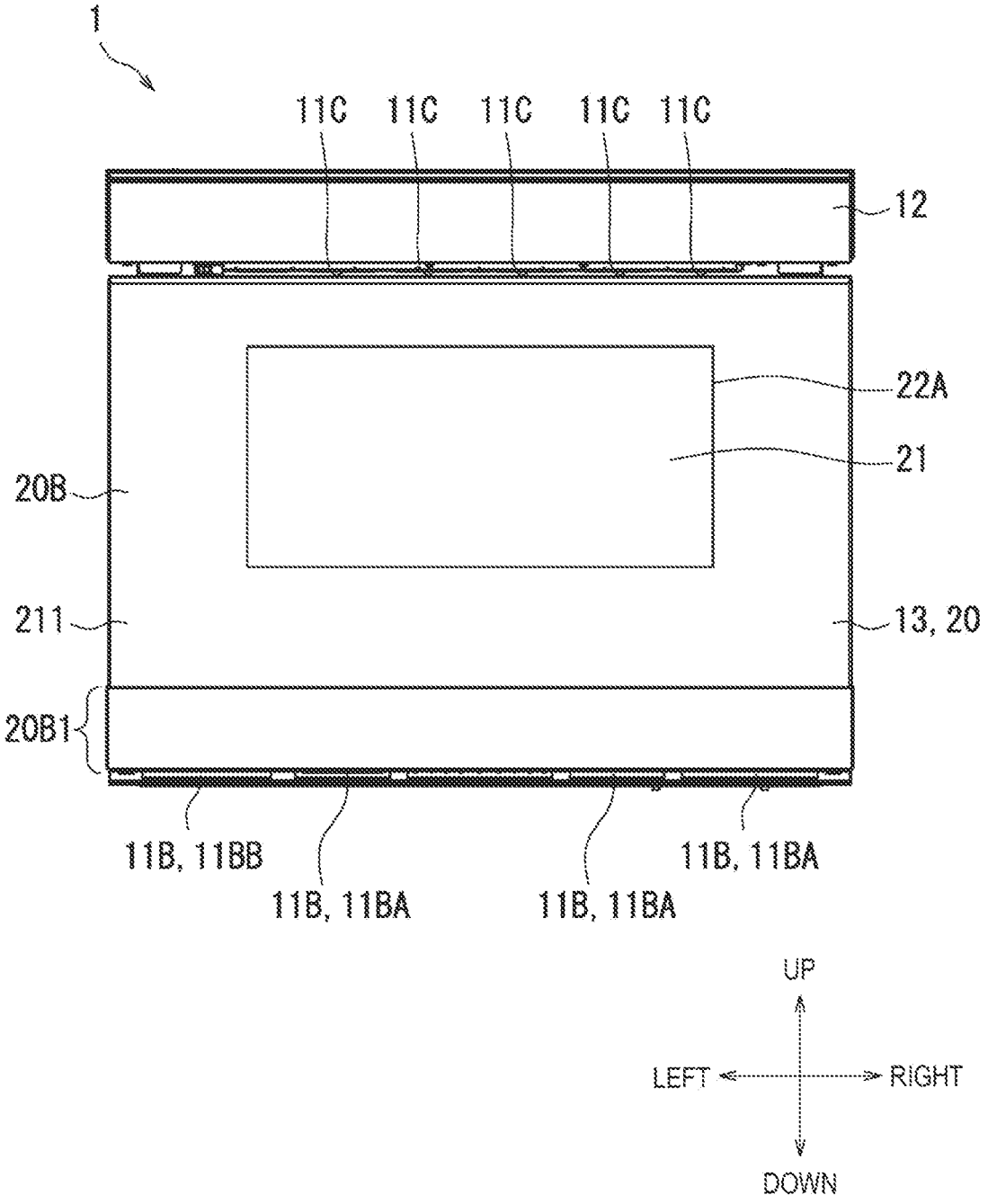
FIG. 5 is a front view of the heating cooking apparatus according to the embodiment of the present invention.

Next, the pull-out body 13 will be further described with reference to FIG. 1 to FIG. 5. FIG. 3 is a diagram illustrating a right side surface of the heating cooking apparatus 1 according to the present embodiment. More specifically, FIG. 3 illustrates the right side surface of the heating cooking apparatus 1 in a state where the housing 14 is removed. FIG. 4 is a diagram illustrating a left side surface of the heating cooking apparatus 1 according to the present embodiment. More specifically, FIG. 4 illustrates the left side surface of the heating cooking apparatus 1 in a state where the housing 14 is removed. FIG. 5 is a front view of the heating cooking apparatus 1 according to the present embodiment.

As illustrated in FIG. 3 and FIG. 4, the pull-out body 13 includes a lid portion 20, a placing portion 131, a pair of left and right slide members 132, and a support member 133.

The lid portion 20 is configured to close the opening 11A (see FIG. 1) of the panel 11. As illustrated in FIG. 5, the lid portion 20 is a plate-like member having a substantially rectangular shape. The lid portion 20 includes a see-through window portion 21. The see-through window portion 21 is located at a substantially center portion of the lid portion 20 in the left-right direction and the up-down direction. The see-through window portion 21 makes the accommodation space 1A (see FIG. 1) in the heating cooking chamber 10 visible. A configuration of the see-through window portion 21 will be described below with reference to FIG. 12. Details of a configuration of the lid portion 20 will be described with reference to FIG. 13 to FIG. 15.

As illustrated in FIG. 3 and FIG. 4, an object to be heated can be placed on the placing portion 131. The lid portion 20 includes a rear surface 20A. The rear surface 20A of the lid portion 20 faces the opening 11A (see FIG. 1) of the panel 11. The placing portion 131 is attached to the rear surface 20A of the lid portion 20.

The pair of left and right slide members 132 support the lid portion 20. The pair of left and right slide members 132 support the placing portion 131 by supporting the lid portion 20. The pair of left and right slide members 132 are attached to the rear surface 20A of the lid portion 20. The pair of left and right slide members 132 include a right slide member 132*a* (see FIG. 3) and a left slide member 132*b* (see FIG. 4). Each of the right slide member 132*a* (see FIG. 3) and the left slide member 132*b* (see FIG. 4) has the front-rear direction as a longitudinal direction.

The support member 133 supports the lid portion 20. The support member 133 supports the placing portion 131 by supporting the lid portion 20. The support member 133 is attached to a substantially center portion of the rear surface 20A of the lid portion 20 in the left-right direction and a portion below the placing portion 131. The support member 133 is a plate-like member with the front-rear direction as a longitudinal direction.

The support member 133 includes a rack portion. The rack portion includes a plurality of teeth. The heating cooking apparatus 1 includes a drive mechanism 36 to be described below with reference to FIG. 11. The drive mechanism 36 is accommodated in an air intake space AR to be described below with reference to FIG. 8. The drive mechanism 36 causes the pull-out body 13 to be in an opened state or a closed state by engaging with the rack portion of the support member 133. The opened state of the pull-out body 13 is a state where the placing portion 131 of the pull-out body 13 is pulled out from the accommodation space 1A. The closed state of the pull-out body 13 is a state where the placing portion 131 of the pull-out body 13 is pulled into the accommodation space 1A.

Figure 6:
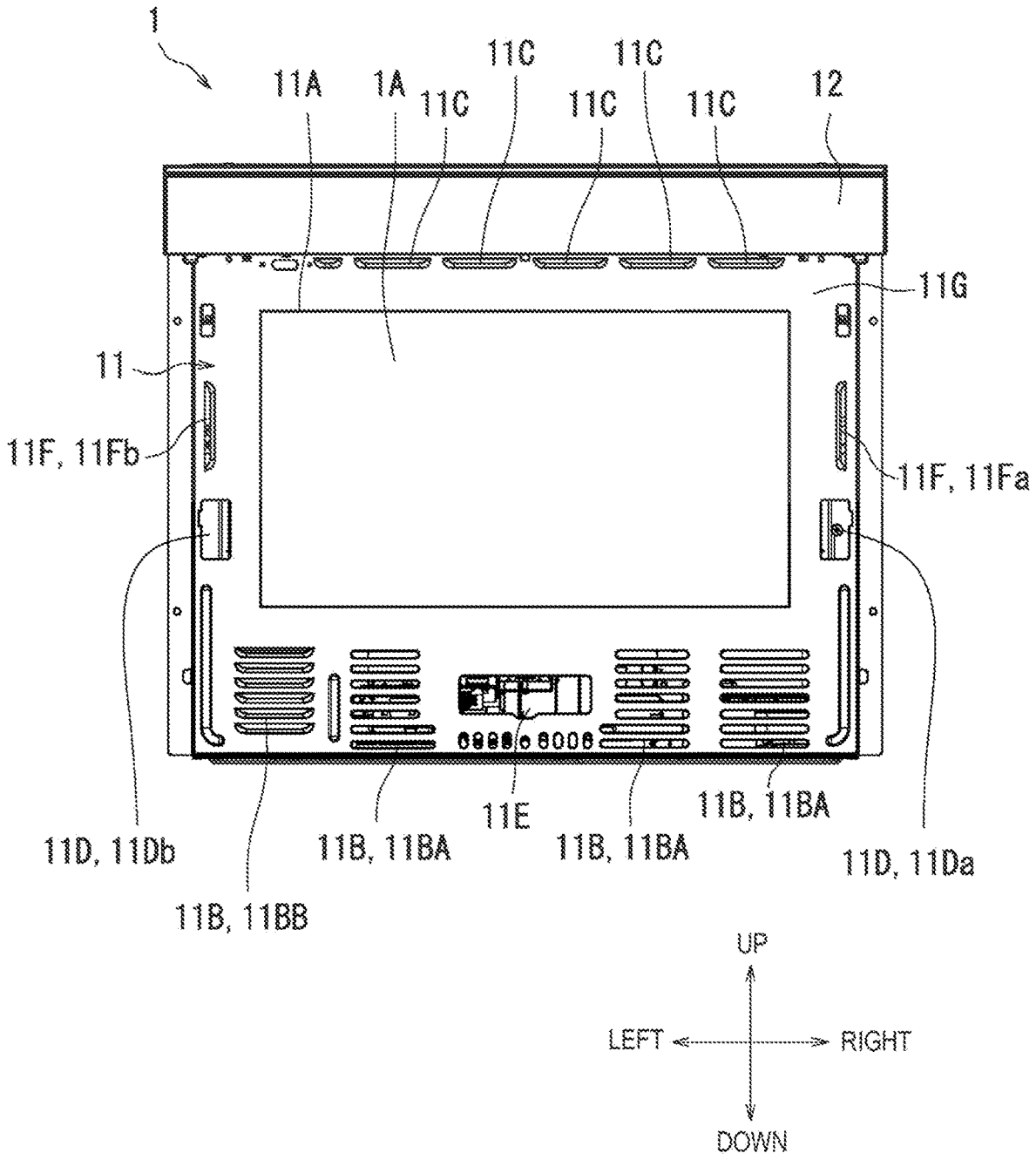
FIG. 6 is a front view of the heating cooking apparatus according to the embodiment of the present invention.

Next, the panel 11 will be further described with reference to FIG. 1 to FIG. 6. FIG. 6 is a front view of the heating cooking apparatus 1 according to the present embodiment. More specifically, FIG. 6 illustrates the heating cooking apparatus 1 in a state where the pull-out body 13 is removed.

As illustrated in FIG. 6, the panel 11 is a rectangular plate-like member. The panel 11 includes a plurality of first through hole portions 11B, a plurality of second through hole portions 11C, a pair of third through hole portions 11D, a fourth through hole portion 11E, and a pair of fifth through hole portions 11F, in addition to the opening 11A. Hereinafter, the plurality of second through hole portions 11C will be collectively referred to as an "exhaust hole portion 11C".

The plurality of first through hole portions 11B are located at a portion below the opening 11A of the panel 11. The plurality of first through hole portions 11B form four columns. In the present embodiment, each of the four columns is composed of six or seven first through hole portions 11B disposed in a row along an up-down direction. Two columns of the four columns are located at a portion proximate to a right end of the panel 11. The other two columns of the four columns are located at a portion proximate to a left end of the panel 11. Hereinafter, the seven first through hole portions 11B constituting each column except for the leftmost column among the four columns may be collectively referred to as an "air intake hole portion 11BA". Hereinafter, the six first through hole portions 11B constituting the leftmost column among the four columns may be collectively referred to as an "exhaust hole portion 11BB". The air intake hole portions 11 BA communicate a space R to be described below with reference to FIG. 7 and FIG. 8 and the outside of the heating cooking apparatus 1 with each other. The air intake hole portions 11BA are located upstream relative to a blown air flow BF that is blown out by a cooling fan 40 to be described below with reference to FIG. 9 to FIG. 11.

The exhaust hole portion 11C communicates the space R to be described below with reference to FIG. 7 and FIG. 8 and the outside of the heating cooking apparatus 1 with each other. The exhaust hole portion 11C is located downstream relative to the blown air flow BF that is blown out by the cooling fan 40 to be described below with reference to FIG. 9 to FIG. 11. Further, the exhaust hole portion 11C is located on the panel 11 at a portion above the opening 11A. The plurality of second through hole portions 11C are disposed in a row from a right portion to a left portion of the panel 11. Further, as illustrated in FIG. 5, the exhaust hole portion 11C is located between the pull-out body 13 (see FIG. 1) and the operation panel unit 12 in the up-down direction.

As illustrated in FIG. 6, the pair of third through hole portions 11D include a right third through hole portion 11Da and a left third through hole portion 11Db. The right third through hole portion 11Da is located on the panel 11 at a portion to the right of the opening 11A. The left third through hole portion 11Db is located on the panel 11 at a portion to the left of the opening 11A. The right slide member 132*a* described with reference to FIG. 3 and FIG. 4 passes through the right third through hole portion 1*l*Da of the panel 11. The left slide member 132*b* described with reference to FIG. 3 and FIG. 4 passes through the left third through hole portion 11Db of the panel 11.

The fourth through hole portion 11E is located on the panel 11 at a portion below the opening 11A of the panel 11 and at a substantially center portion of the panel 11 in the left-right direction. The support member 133 described with reference to FIG. 3 and FIG. 4 passes through the fourth through hole portion 11E of the panel 11.

The pair of fifth through hole portions 11F include a right fifth through hole portion 11Fa and a left fifth through hole portion 11Fb. The right fifth through hole portion 11Fa faces the right air supply hole portion 23Aa, which will be described below with reference to FIG. 14, in the closed state of the pull-out body 13. More specifically, the right fifth through hole portion 11Fa is located on the panel 11 at a portion to the right of the opening 11A and at a portion above the right third through hole portion 11Da. The left fifth through hole portion 11Fb faces the left air supply hole portion 23Ab, which will be described below with reference to FIG. 14, in the closed state of the pull-out body 13. More specifically the left fifth through hole portion 11Fb is located on the panel 11 at a portion to the left of the opening 11A and at a portion above the left third through hole portion 11Db. The closed state of the pull-out body 13 includes a state where the lid portion 20 described with reference to FIG. 3 and FIG. 4 closes the opening 11A.

Next, a configuration of the heating cooking apparatus 1 will be further described with reference to FIG. 1 to FIG. 6.

As illustrated in FIG. 3 and FIG. 4, the heating cooking apparatus 1 further includes a pair of left and right connecting portions 15 and a pair of left and right slide rails 16.

The pair of left and right connecting portions 15 connect the pair of left and right slide rails 16 and the heating cooking chamber 10. The pair of left and right connecting portions 15 include a right connecting portion 15*a* (see FIG. 3) and a left connecting portion 15*b* (see FIG. 4). As illustrated in FIG. 3, the heating cooking chamber 10 includes a right wall 10A. The right connecting portion 15*a* is attached to the right wall 10A of the heating cooking chamber 10. As illustrated in FIG. 4, the heating cooking chamber 10 includes a left wall 10B. The left connecting portion 15*h* is attached to the left wall 10B of the heating cooking chamber 10. Configurations of the right connecting portion 15*a* and the left connecting portion 15*b* are substantially the same.

The pair of left and right slide rails 16 slidably support the pull-out body 13 in the front-rear direction. As illustrated in FIG. 3 and FIG. 4, the pair of left and right slide rails 16 include a right slide rail 16*a* (see FIG. 3) and a left slide rail 16*b* (see FIG. 4).

The right slide rail 16*a* and the left slide rail 16*b* are attached to an outer surface of the heating cooking chamber 10. More specifically, as illustrated in FIG. 3, the right slide rail 16*a* is attached to the right connecting portion 15*a*. As illustrated in FIG. 4, the left slide rail 16*b* is attached to the left connecting portion 15*b*. Each of the right slide rail 16*a* and the left slide rail 16*b* includes a rail portion with the front-rear direction as a longitudinal direction. The rail portion of the right slide rail 16*a* engages with the right slide member 132*a*. The right slide member 132*a* is slidably supported by the right slide rail 16*a*. The rail portion of the left slide rail 16*b* engages with the left slide member 132*b*. The left slide member 132*b* is slidably supported by the left slide rail 16*b*. Configurations of the right slide rail 16*a* and the left slide rail 16*b* are substantially the same.

Next, the configuration of the heating cooking apparatus 1 according to the present embodiment will be further described with reference to FIG. 1 to FIG. 8. FIG. 7 is a cross-sectional view of the heating cooking apparatus 1 along a section line VII in FIG. 1. FIG. 8 is a cross-sectional view of the heating cooking apparatus 1 along a section line VIII in FIG. 1.

Figure 7:
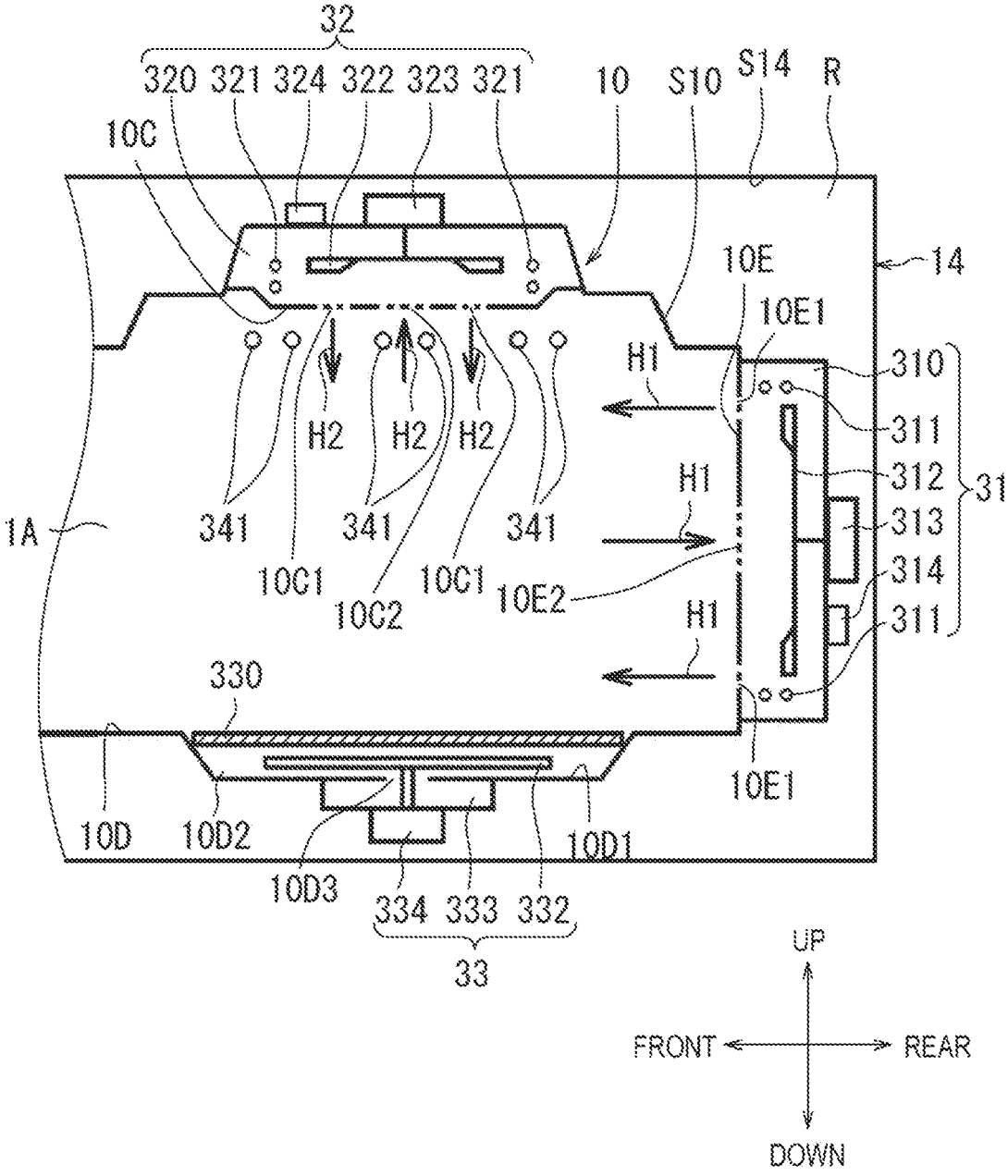
FIG. 7 is a cross-sectional view of the heating cooking apparatus along a section line VII in FIG. 1.

As illustrated in FIG. 7, the heating cooking chamber 10 includes an upper wall 10C, a lower wall 10D, and a rear wall 10E, in addition to the right wall 10A and the left wall 10B. The accommodation space 1A is formed by the right wall 10A, the left wall 10B, the upper wall 10C, the lower wall 10D, and the rear wall 10E. The accommodation space 1A of the heating cooking chamber 10 has a substantially rectangular parallelepiped shape.

Figure 8:
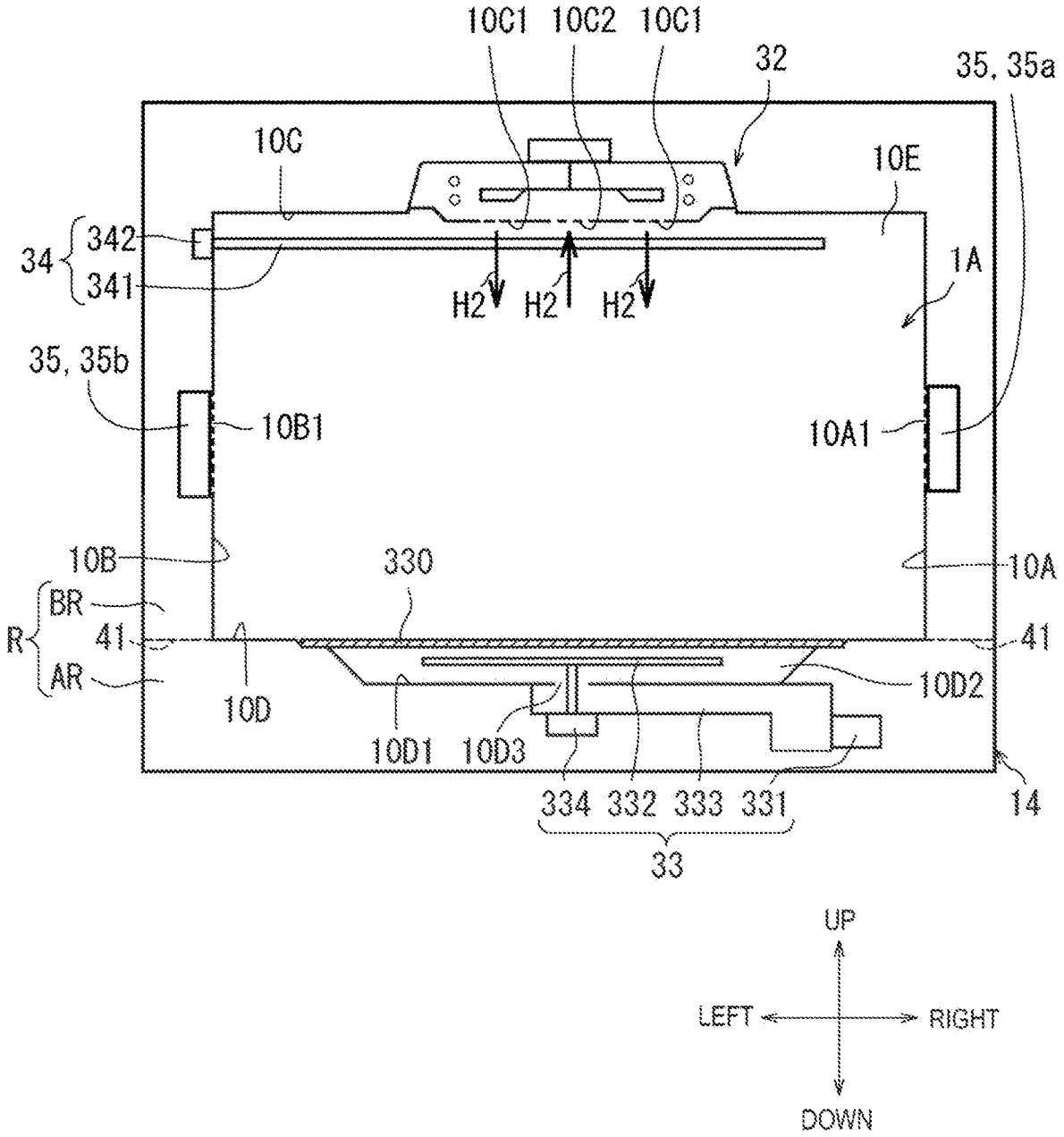
FIG. 8 is a cross-sectional view of the heating cooking apparatus along a section line VIII in FIG. 1.

The heating cooking apparatus 1 further includes a first air sending unit 31, a second air sending unit 32, a microwave supply unit 33, a grill unit 34 (see FIG. 8), and a damper unit 35 (see FIG. 8). The heating cooking apparatus 1 includes a space R. The space R is formed between an outer surface S10 of the heating cooking chamber 10 and an inner surface S14 of the housing 14. The first air sending unit 31, the second air sending unit 32, and the grill unit 34 are examples of heat supply units. The space R is an example of a first space.

The first air sending unit 31 supplies first hot air H1 into the accommodation space 1A. In other words, the first air sending unit 31 executes a first hot air circulation heating mode. The first air sending unit 31 is attached to the outer side of the rear wall 10E. The rear wall 10E includes a plurality of first blow-out hole portions 10E1 and a plurality of first intake hole portions 10E2. The plurality of first intake hole portions 10E2 are located at a substantially center portion of the rear wall 10E. The plurality of first blow-out hole portions 10E1 are located on the rear wall 10E at an outer portion of the plurality of first intake hole portions 10E2 in the rear wall 10E.

The first air sending unit 31 includes a first air sending chamber 310, a first heater 311, a first centrifugal fan 312, a first drive unit 313, and a first energization unit 314. The first heater 311 and the first centrifugal fan 312 are accommodated in the first air sending chamber 310. The first drive unit 313 and the first energization unit 314 are located outside the first air sending chamber 310.

The first energization unit 314 energizes the first heater 311. The energized first heater 311 heats air in the first air sending chamber 310. The first drive unit 313 drives the first centrifugal fan 312. The driven first centrifugal fan 312 blows air in the first air sending chamber 310 into the accommodation space 1A through the plurality of first blow-out hole portions 10E1. Further, the driven first centrifugal fan 312 draws air in the accommodation space 1A into the first air sending chamber 310 through the plurality of first intake hole portions 10E2. The plurality of first intake hole portions 10E2 face the first centrifugal fan 312 in an axial direction of the first centrifugal fan 312. The first heater 311 is, for example, a sheathed heater. The first drive unit 313 is, for example, a motor.

The second air sending unit 32 supplies second hot air H2 into the accommodation space 1A. In other words, the second air sending unit 32 executes the second hot air circulation heating mode. The second air sending unit 32 is attached to the outer side of the upper wall 10C. The upper wall 10C includes a plurality of second blow-out hole portions 10C1 and a plurality of second intake hole portions 10C2. The plurality of second blow-out hole portions 10C1 and the plurality of second intake hole portions 10C2 are located at a substantially center portion of the upper wall 10C.

The second air sending unit 32 includes a second air sending chamber 320, a second heater 321, a second centrifugal fan 322, a second drive unit 323, and a second energization unit 324. The second heater 321 and the second centrifugal fan 322 are accommodated in the second air sending chamber 320. The second drive unit 323 and the second energization unit 324 are located outside the second air sending chamber 320.

The second energization unit 324 energizes the second heater 321. The energized second heater 321 heats air in the second air sending chamber 320. The second drive unit 323 drives the second centrifugal fan 322. The driven second centrifugal fan 322 blows air in the second air sending chamber 320 into the accommodation space 1A through the plurality of second blow-out hole portions 10C1. Further, the driven second centrifugal fan 322 draws air in the accommodation space 1A into the second air sending chamber 320 through the plurality of second intake hole portions 10C2. The plurality of second intake hole portions 10C2 face the second centrifugal fan 322 in an axial direction of the second centrifugal fan 322. The second heater 321 is, for example, a sheathed heater. The second drive unit 323 is, for example, a motor.

The microwave supply unit 33 supplies microwaves into the accommodation space 1A. In other words, the microwave supply unit 33 executes the microwave heating mode. The microwave supply unit 33 is attached to the lower wall 10D.

As illustrated in FIG. 8, the microwave supply unit 33 includes a magnetron 331, a rotary antenna 332, a waveguide 333, and an antenna motor 334. The lower wall 10D includes a recessed portion 10D1. The recessed portion 10D1 is located at a substantially center portion of the lower wall 10D. The heating cooking chamber 10 includes an oven tray 330. The oven tray 330 is attached to the lower wall 10D. The oven tray 330 is a plate-like member. The oven tray 330 covers the recessed portion 10D1. The oven tray 330 and the recessed portion 10D1 form a space 10D2 therebetween.

The rotary antenna 332 is located in the space 10D2. The magnetron 331, the waveguide 333, and the antenna motor 334 are located outside the recessed portion 10D1. The magnetron 331 generates microwaves. The recessed portion 10D1 includes a power supply hole portion 10D3. The waveguide 333 propagates the generated microwaves to the power supply hole portion 10D3. As a result, the microwaves are supplied into the accommodation space 1A via the rotary antenna 332. The antenna motor 334 drives the rotary antenna 332. The rotary antenna 332 agitates the microwaves and radiates the microwaves into the accommodation space 1A.

The material of the oven tray 330 includes ceramic or glass. Because the material of the oven tray 330 includes ceramic or glass, the oven tray 330 facilitates transmission of the microwaves. Therefore, when the microwave heating mode is executed, the microwaves are supplied from the recessed portion 10D1, and the heating cooking apparatus 1 can efficiently heat and cook an object to be heated.

The grill unit 34 mainly supplies heat radiation into the accommodation space 1A. The grill unit 34 executes the grill heating mode. The grill unit 34 includes a heating cooking heater unit 341 and a third energization unit 342. The heating cooking heater unit 341 is located at an upper portion in the accommodation space 1A. The heating cooking heater unit 341 projects from the inner surface of the left wall 10B of the heating cooking chamber 10. The third energization unit 342 is located outside the left wall 10B. The third energization unit 342 projects from the outer surface of the left wall 10B of the heating cooking chamber 10. The third energization unit 342 energizes the heating cooking heater unit 341. The energized heating cooking heater unit 341 generates and radiates heat. The heating cooking heater unit 341 is, for example, a U-shaped sheathed heater.

As illustrated in FIG. 7, in the present embodiment, the heating cooking heater unit 341 of the grill unit 34 is located at a substantially center portion in the front-rear direction. Accordingly, the heating cooking heater unit 341 of the grill unit 34 is easily to be located directly above the object to be heated. As a result, the heating cooking apparatus 1 can heat the object to be heated more uniformly when the grill unit 34 is driven.

As illustrated in FIG. 8, the right wall 10A includes a plurality of air supply hole portions 10A1. The plurality of air supply hole portions 10A1 pass through the right wall 10A. The left wall 10B includes a plurality of exhaust hole portions 10B1. The plurality of exhaust hole portions 10B1 pass through the left wall 10B.

The damper unit 35 opens or closes the plurality of air supply hole portions 10A1 and the plurality of exhaust hole portions 10B1. For example, when the damper unit 35 opens the plurality of air supply hole portions 10A1 and the plurality of exhaust hole portions 10B 1, the accommodation space 1A communicates with the space R. When the damper unit 35 closes the plurality of air supply hole portions 10A1 and the plurality of exhaust hole portions 10B1, the accommodation space 1A does not communicate with the space R. The damper unit 35 includes an air supply damper 35*a* and an exhaust damper 35*b*.

The air supply damper 35*a* opens or closes the plurality of air supply hole portions 10A1. The air supply damper 35*a* is attached to the outer side of the right wall 10A.

The exhaust damper 35*b* opens or closes the plurality of exhaust hole portions 10B1. The exhaust damper 35*b* is attached to the outer side of the left wall 10B. As illustrated in FIG. 4, the exhaust damper 35*b* includes a humidity sensor 35*b*1. The humidity sensor 35*b*1 detects the amount of vapor included in the air discharged from the accommodation space 1A (see FIG. 8) through the plurality of exhaust hole portions 10B1 when the plurality of exhaust hole portions 10B1 (see FIG. 8) are opened. Accordingly, when the microwave heating mode is executed, the heating cooking apparatus 1 can detect a finish of the object to be heated that has been heated and cooked based on the amount of vapor detected by the humidity sensor 35*b*1. The exhaust damper 35*b* guides the air discharged from the accommodation space 1A (see FIG. 8) through the plurality of exhaust hole portions 10B1 (see FIG. 8) to the exhaust hole portion 11BB (see FIG. 6) without bringing the air into contact with the air in the space R (see FIG. 8).

The temperature of the outer surface of the heating cooking chamber 10 tends to become high as the temperature in the accommodation space 1A rises due to the drive of the first air sending unit 31, the second air sending unit 32, or the grill unit 34. The pair of left and right connecting portions 15, the pair of left and right slide rails 16, and the pair of left and right slide members 132 are made of a metal. The heat from the outer surface of the heating cooking chamber 10 is easily to be heat-transferred to the pair of left and right connecting portions 15, the pair of left and right slide rails 16, and the pair of left and right slide members 132. For this reason, the temperature of the pair of left and right connecting portions 15, the pair of left and right slide rails 16, and the pair of left and right slide members 132 become high as the temperature in the accommodation space 1A rises.

Figure 9:
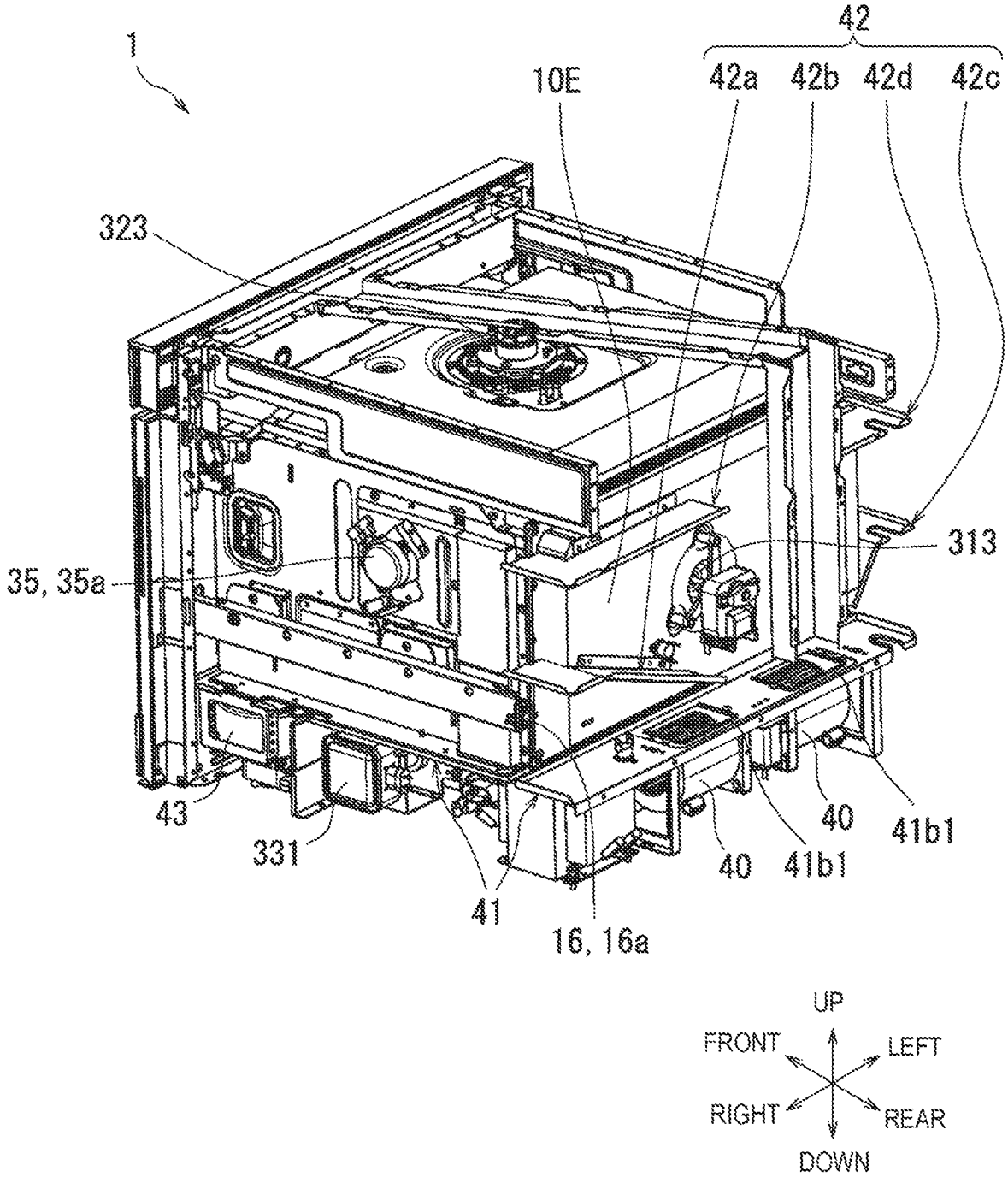
FIG. 9 is a perspective view of the heating cooking apparatus according to the embodiment of the present invention.
Figure 10:
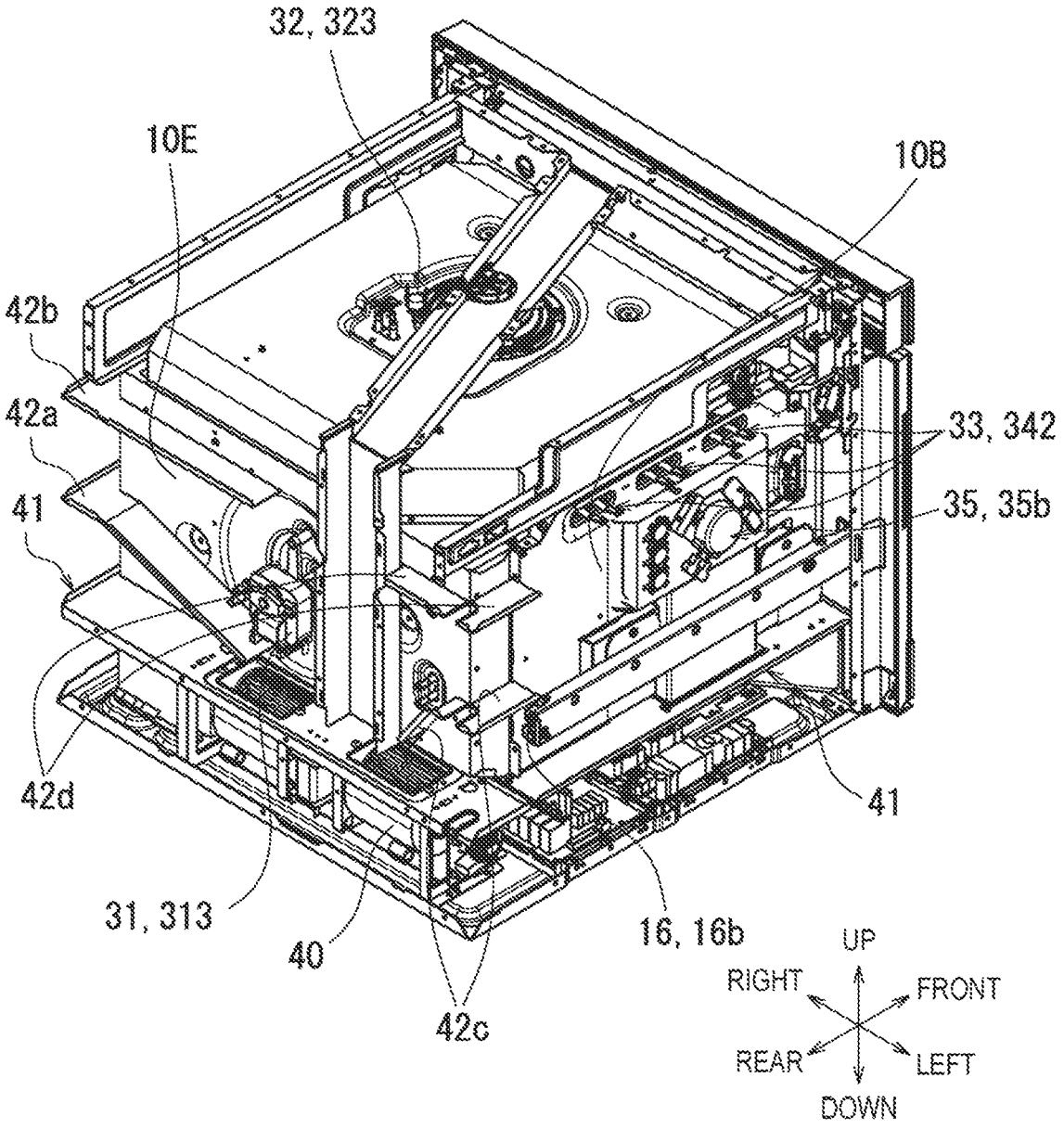
FIG. 10 is a perspective view of the heating cooking apparatus according to the embodiment of the present invention.

Next, the configuration of the heating cooking apparatus 1 will be further described with reference to FIG. 1 to FIG. 10. FIG. 9 is a perspective view of the heating cooking apparatus 1 according to the present embodiment. More specifically, FIG. 9 illustrates the heating cooking apparatus 1 in a state where the housing 14 is removed, in an upper right diagonal direction from behind. FIG. 10 is a perspective view of the heating cooking apparatus 1 according to the present embodiment. More specifically, FIG. 10 illustrates the heating cooking apparatus 1 in a state where the housing 14 is removed, in an upper left diagonal direction from behind.

As illustrated in FIG. 9, the heating cooking apparatus 1 further includes a cooling fan 40, a partition plate 41, a plurality of air deflecting plates 42, and a magnetron fan 43. The cooling fan 40, the partition plate 41, the plurality of air deflecting plates 42, and the magnetron fan 43 are located in the space R (see FIG. 7). The cooling fan 40 is an example of a fan.

The cooling fan 40 mainly cools components to be cooled that are disposed around the outer surface of the heating cooking chamber 10 (see FIG. 7). The components to be cooled include the pair of left and right slide members 132, the pair of left and right slide rails 16, the lid portion 20, the first air sending unit 31, the second air sending unit 32, and the grill unit 34. More specifically, the cooling fan 40 takes air outside of the heating cooking apparatus 1 into the space R (see FIG. 7) and discharges air in the space R (see FIG. 7) to the outside of the heating cooking apparatus 1. As illustrated in FIG. 9, the cooling fan 40 is located at a lower and rear portion of the space R (see FIG. 7). The cooling fan 40 is located at the same height as the height of the air intake hole portion 11BA (see FIG. 6) of the panel 11. The cooling fan 40 blows out air in an upward direction to generate a blown air flow BF. In the present embodiment, the cooling fan 40 is a cross-flow fan.

As illustrated in FIG. 8, the partition plate 41 partitions the space R into an air intake space AR and an exhaust space BR. The air intake space AR is located below the partition plate 41 in the space R in the up-down direction. The exhaust space BR is located above the partition plate 41 in the space R in the up-down direction. In the air intake space AR, an intake air flow AF generated by the drive of the cooling fan 40 flows. The intake air flow AF indicates a flow of air that flows from the outside of the heating cooking apparatus 1 toward the cooling fan 40 through the plurality of air intake hole portions 11BA (see FIG. 6). In the exhaust space BR, the blown air flow BF generated by the drive of the cooling fan 40 flows. As illustrated in FIG. 9, the partition plate 41 includes two blow-out hole portions 41*b*1. The blown air flow BF is blown upward from the cooling fan 40 through two blow-out hole portions 41*b*1 of the partition plate 41. The blown air flow BF mainly indicates a flow of air toward the exhaust hole portion 11C (see FIG. 6).

As illustrated in FIG. 9 and FIG. 10, the partition plate 41 is located at a portion above the cooling fan 40 in the space R and a portion below the pair of left and right slide rails 16. The partition plate 41 is attached to the outer surface of the heating cooking chamber 10 across a front end portion of the right wall 10A of the heating cooking chamber 10 to a front end portion of the left wall 10B of the heating cooking chamber 10.

In the present embodiment, as illustrated in FIG. 8, the magnetron 331 of the microwave supply unit 33 is located in the air intake space AR. The pair of left and right slide rails 16, the first air sending unit 31, the second air sending unit 32, and the third energization unit 342 of the grill unit 34 are located in the exhaust space BR. Thus, the temperature of the air in the exhaust space BR tends to become higher than the temperature of the air in the air intake space AR due to the drive of the heating cooking apparatus 1.

As illustrated in FIG. 9, the plurality of air deflecting plates 42 branch the blown air flow BF that is blown out by the cooling fan 40 in an upward direction, guide the blown air flow BF to the components to be cooled, and split the blown air flow BF into an airflow sufficient to cool each of the components to be cooled. More specifically, the plurality of air deflecting plates 42 function as a duct that branches part of the blown air flow BF into five air flows. The plurality of air deflecting plates 42 are attached to an outer surface of the rear wall 10E of the heating cooking chamber 10. The plurality of air deflecting plates 42 include a first air deflecting plate 42*a*, a second air deflecting plate 42*b*, a third air deflecting plate 42*c*, and a fourth air deflecting plate 42*d*.

The first air deflecting plate 42*a* guides part of the blown air flow BF blown out by the cooling fan 40 in the upward direction to the right slide rail 16*a*. Further, the first air deflecting plate 42*a* splits the blown air flow BF into an air flow sufficient to cool the right slide rail 16*a*. Accordingly, the first air deflecting plate 42*a* functions as an air deflecting plate for the right slide rail.

The second air deflecting plate 42*b* guides part of the blown air flow BF blown out by the cooling fan 40 in the upward direction to the air supply damper 35*a*. Accordingly, the second air deflecting plate 42*b* functions as an air deflecting plate for the air supply damper.

As illustrated in FIG. 10, the third air deflecting plate 42*c* guides part of the blown air flow BF blown out by the cooling fan 40 in the upward direction to the left slide rail 16*b*. The third air deflecting plate 42*c* splits the blown air flow BF into an air flow sufficient to cool the left slide rail 16*b*. Accordingly, the third air deflecting plate 42*c* functions as an air deflecting plate for the left slide rail.

The fourth air deflecting plate 42*d* guides part of the blown air flow BF blown out by the cooling fan 40 in the upward direction to the third energization unit 342 of the grill unit 34. The fourth air deflecting plate 42*d* splits the blown air flow BF into an air flow sufficient to cool the third energization unit 342 of the grill unit 34. Accordingly, the fourth air deflecting plate 42*d* functions as an air deflecting plate for the grill unit.

As illustrated in FIG. 9, the magnetron fan 43 cools the magnetron 331 of the microwave supply unit 33. More specifically, the magnetron fan 43 suctions air outside of the heating cooking apparatus 1 through the plurality of air intake hole portions 11BA described with reference to FIG. 6 and blows the air onto the magnetron 331. The operation characteristics of the magnetron 331 depend on the temperature of the magnetron 331. Thus, the magnetron fan 43 inhibits fluctuations in the operation characteristics of the magnetron 331. The magnetron fan 43 is located below the heating cooking chamber 10 and in front of the magnetron 331. The magnetron fan 43 is, for example, a sirocco fan.

Figure 11:
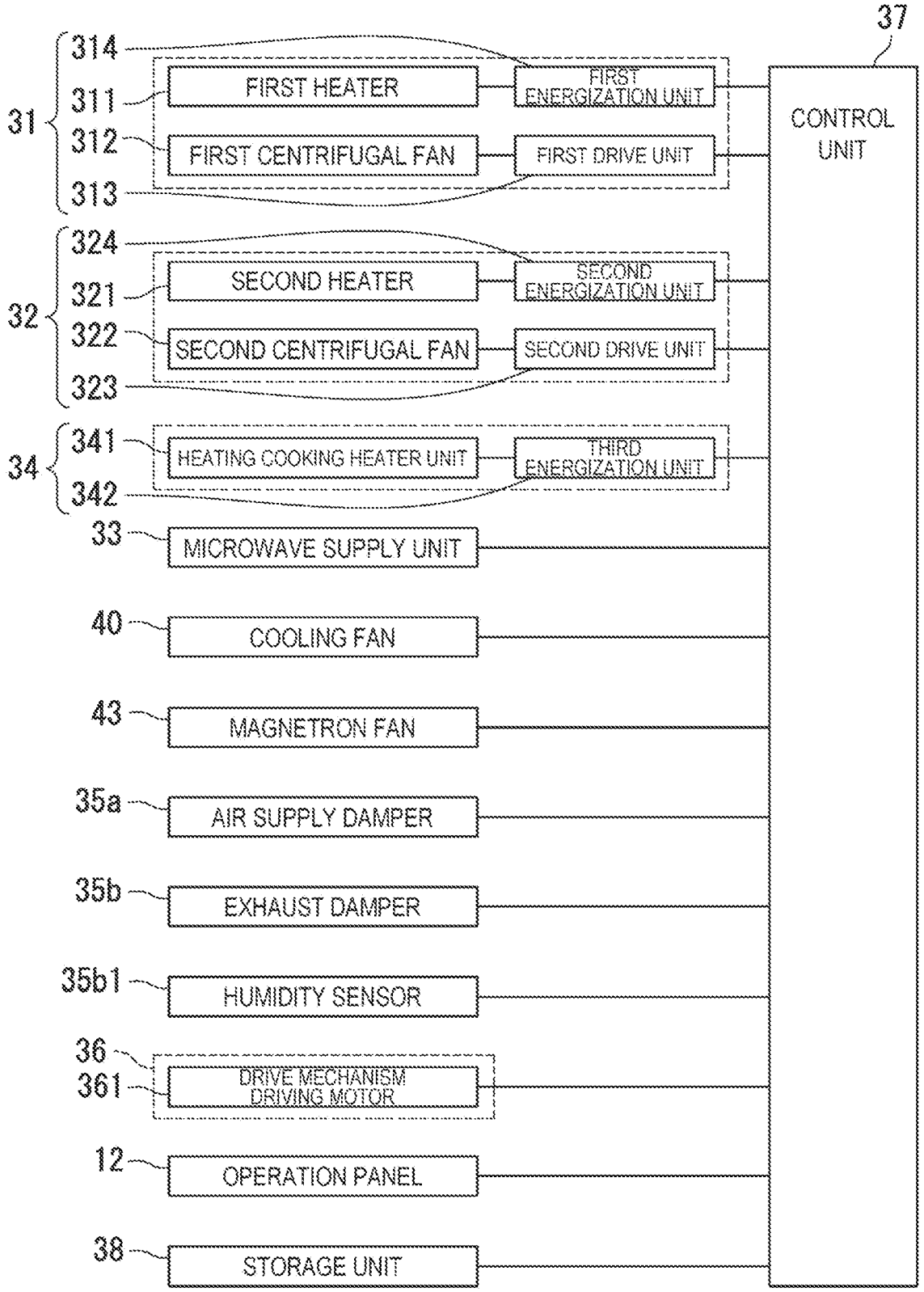
FIG. 11 is a block diagram illustrating a configuration of the heating cooking apparatus according to the embodiment of the present invention.

The configuration of the heating cooking apparatus 1 will be further described with reference to FIG. 11. FIG. 11 is a block diagram illustrating the configuration of the heating cooking apparatus 1 according to the present embodiment.

As illustrated in FIG. 11, the heating cooking apparatus 1 further includes a drive mechanism 36, a control unit 37, and a storage unit 38.

The drive mechanism 36 includes a drive mechanism driving motor 361 and a rack pinion mechanism. The rack pinion mechanism includes a pinion. The control unit 37 controls the drive mechanism driving motor 361 to generate a driving force for rotating the pinion in a forward direction or a reverse direction. The pinion engages with the rack portion of the support member 133 described with reference to FIG. 3 and FIG. 4. The drive mechanism 36 sets the pull-out body 13 to be in an open state or a closed state by rotating the pinion in a forward direction or a reverse direction.

The storage unit 38 is constituted by a Random Access Memory (RAM) and a Read Only Memory (ROM). The storage unit 38 stores control programs used for controlling the operation of each portion of the heating cooking apparatus 1. The storage unit 38 stores setting information input by operating the operation panel unit 12.

The control unit 37 is a hardware circuit. The hardware circuit includes a processor such as a Central Processing Unit (CPU). The control unit 37 executes control programs stored in the storage unit 38 to thereby control the operation panel unit 12, the first drive unit 313, the first energization unit 314, the second drive unit 323, the second energization unit 324, the third energization unit 342, the microwave supply unit 33, the air supply damper 35*a*, the exhaust damper 35*b*, the cooling fan 40, the magnetron fan 43, the drive mechanism driving motor 361, and the storage unit 38.

The control unit 37 controls the drive of the cooling fan 40 and the magnetron fan 43 according to the type of heating cooking mode received by the operation panel unit 12. When being operated by a user, the operation panel unit 12 receives a command to set any one of heating cooking mode among the microwave heating mode, the first hot air circulation heating mode, the second hot air circulation heating mode, and the grill heating mode. The control unit 37 sets the heating cooking mode according to the command received by the operation panel unit 12. For example, when the control unit 37 sets the first hot air circulation heating mode, the second hot air circulation heating mode, or the grill heating mode as the heating cooking mode, the control unit 37 drives the cooling fan 40. In this case, the control unit 37 does not drive the magnetron fan 43. When the control unit 37 sets the microwave heating mode as the heating cooking mode, for example, the control unit 37 drives the cooling fan 40 and the magnetron fan 43.

The control unit 37 controls the air supply damper 35*a* and the exhaust damper 35*b* according to the type of heating cooking mode received by the operation panel unit 12. More specifically, when the control unit 37 sets the first hot air circulation heating mode, the second hot air circulation heating mode, or the grill heating mode as the heating cooking mode, the control unit 37 causes the air supply damper 35*a* and the exhaust damper 35*b* to close the air supply hole portions 10A1 and the exhaust hole portions 10B1, respectively. In this manner, when the first hot air circulation heating mode, the second hot air circulation heating mode, or the grill heating mode is executed, the accommodation space 1A is closed. As a result, the temperature in the accommodation space 1A is maintained.

When the control unit 37 sets the microwave heating mode as the heating cooking mode, the control unit 37 causes the air supply damper 35*a* and the exhaust damper 35*b* to open the air supply hole portions 10A1 and the exhaust hole portions 10B1, respectively. In this manner, when the microwave heating mode is executed, the accommodation space 1A is opened. As a result, the damper unit 35 can detect a finish of the object to be heated that has been heated and cooked.

More specifically, when the microwave heating mode is executed, water vapor emitted from the object to be heated in the accommodation space 1A travels from the accommodation space 1A into the exhaust damper 35*b*. The humidity sensor 35*b*1 detects the amount of vapor in the exhaust damper 35*b*. The amount of vapor in the exhaust damper 35*b* depends on the temperature of the object to be heated that has been heated and cooked. The control unit 37 determines whether the amount of vapor detected by the humidity sensor 35*b*1 is equal to or more than a predetermined value. The predetermined value indicates an amount of vapor that corresponds to a desired finishing temperature of the object to be heated. When the control unit 37 determines that the amount of vapor detected by the humidity sensor 35*b*1 is equal to or more than the predetermined value, the control unit 37 terminates the drive of the microwave supply unit 33. When the control unit 37 determines that the amount of vapor detected by the humidity sensor 35*b*1 is not equal to or more than the predetermined value, the control unit 37 does not terminate the drive of the microwave supply unit 33. The storage unit 38 stores the predetermined value. The air inside the exhaust damper 35*b* is discharged to the outside of the heating cooking apparatus 1 through the exhaust hole portion 11BB described with reference to FIG. 6.

Figure 12:
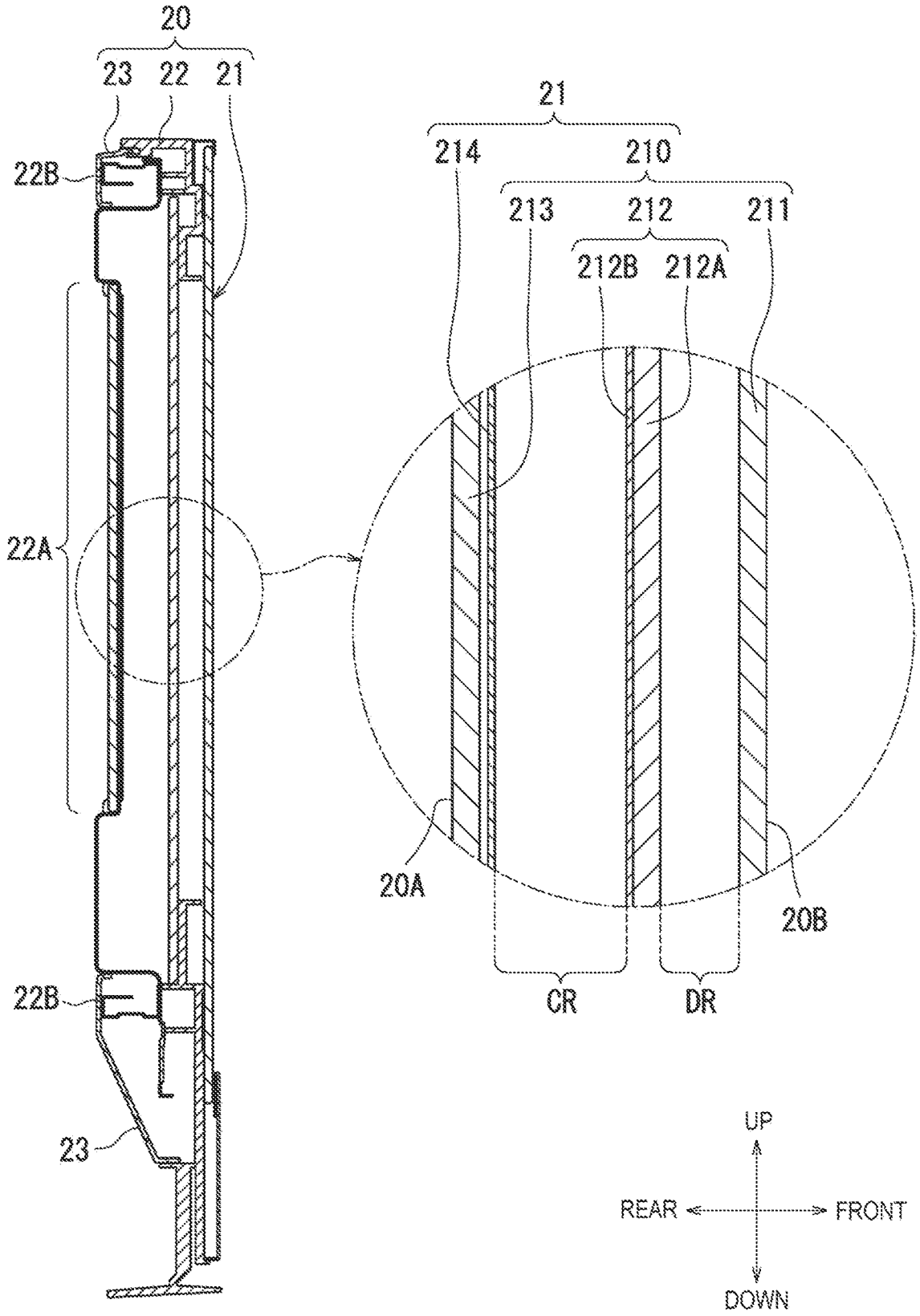
FIG. 12 is a cross-sectional view of a lid portion of a pull-out body along the section line XII in FIG. 1.

Next, the configuration of the see-through window portion 21 of the pull-out body 13 will be further described with reference to FIG. 12. FIG. 12 is a cross-sectional view of the lid portion 20 of the pull-out body 13 along a section line XII in FIG. 1.

As illustrated in FIG. 12, in the present embodiment, the lid portion 20 includes the see-through window portion 21 described with reference to FIG. 5, a frame portion 22, and a cover member 23. The frame portion 22 includes an opening portion 22A. The opening portion 22A is located at a substantially center portion of the frame portion 22 in the up-down direction and the left-right direction. The opening portion 22A passes through the frame portion 22 in the front-rear direction. The see-through window portion 21 is attached to the opening portion 22A of the frame portion 22. In other words, the frame portion 22 supports the see-through window portion 21. The see-through window portion 21 faces the accommodation space 1A in a closed state of the pull-out body 13. Details of a configuration of the frame portion 22 will be described below with reference to FIG. 14. Details of a configuration of the cover member 23 will be described below with reference to FIG. 14 to FIG. 16.

In the present embodiment, the see-through window portion 21 of the lid portion 20 includes three glass plates 210 and a punched metal plate 214. The three glass plates 210 include a front glass plate 211, a heat-ray reflecting glass 212, and a rear glass plate 213. The rear glass plate 213 is an example of a first glass plate. The front glass plate 211 is an example of a second glass plate.

The front glass plate 211, the heat-ray reflecting glass 212, the punched metal plate 214, and the rear glass plate 213 are arranged, in this order, side by side in a line at intervals along a pull-out direction of the pull-out body 13. In other words, among the three glass plates 210, the rear glass plate 213 is located closest to the accommodation space 1A. The front glass plate 211 is located opposite to the accommodation space 1A. The heat-ray reflecting glass 212 is located between the rear glass plate 213 and the front glass plate 211. In other words, the heat-ray reflecting glass 212 is located adjacent to the rear glass plate 213.

Each of the front glass plate 211, the heat-ray reflecting glass 212, and the rear glass plate 213 has a rectangular shape. Each of the front glass plate 211, the heat-ray reflecting glass 212, and the rear glass plate 213 has a smaller area in this order. As illustrated in FIG. 5, the lid portion 20 includes a front surface 20B. The front surface 20B includes a lower area 20B1. In the present embodiment, the front glass plate 211 covers a portion excluding the lower area 20B1 of the front surface 20B of the lid portion 20. That is, the front glass plate 211 covers the most part of the front surface 20B of the lid portion 20. Accordingly, the temperature of the outer surface of the lid portion 20 depends on the temperature of the front glass plate 211. The temperature of the outer surface of the lid portion 20 indicates the temperature of the front surface 20B of the lid portion 20.

In the present embodiment, each of the front glass plate 211 and the rear glass plate 213 includes a float heat-resistant tempered glass, a frosted plate heat-resistant tempered glass, a figured heat-resistant tempered glass, a low-reflection glass, a float plate glass, a polished plate glass, a figured plate glass, a wire mesh plate glass, a wire plate glass, a laminated glass, a tempered glass, an insulating glass, or a double-tempered glass. The thickness of each of the front glass plate 211 and the rear glass plate 213 is preferably 3 mm or more and 12 mm or less, and more preferably 3 mm from the perspective of costs and the like. Each of the front glass plate 211 and the rear glass plate 213 may be a commercial product.

Subsequently, the heat-ray reflecting glass 212 and the punched metal plate 214 will be further described with reference to FIG. 12. The heat-ray reflecting glass 212 reflects heat rays (infrared rays). The heat rays include far-infrared rays. Specifically, the heat-ray reflecting glass 212 mainly reflects heat rays radiated from the first heater 311 (see FIG. 7) of the first air sending unit 31, the second heater 321 (see FIG. 7) of the second air sending unit 32, or the heating cooking heater unit 341 (see FIG. 8) of the grill unit 34.

As illustrated in FIG. 12, the heat-ray reflecting glass 212 includes a glass substrate 212A and a heat-ray reflective film 212B. The heat-ray reflective film 212B is layered on the entire surface of one surface of the glass substrate 212A. The heat-ray reflecting glass 212 is disposed such that the heat-ray reflective film 212B is located proximate to the accommodation space 1A in the lid portion 20.

The glass substrate 212A includes a float heat-resistant tempered glass, a frosted plate heat-resistant tempered glass, a figured heat-resistant tempered glass, a low-reflection glass, a float plate glass, a polished plate glass, a figured plate glass, a wire mesh plate glass, a wire plate glass, a laminated glass, a tempered glass, an insulating glass, or a double-tempered glass. The thickness of the glass substrate 212A is, for example, 8 mm or more and 12 mm or less.

The heat-ray reflective film 212B reflects heat rays. The heat-ray reflective film 212B includes a metal oxide film, a metal film, an alloy film, or a layered film. The layered film indicates a layered body of a metal oxide film and a metal film. The material of the metal film includes, for example, silver (Ag). The material of the alloy layer includes, for example, silver (Ag), palladium (Pd), gold (Au), copper (Cu), or platinum (Pt). The material of a metal oxide film includes, for example, bismuth oxide ($Bi_2O_3$), tin oxide ($SnO_2$), zinc oxide (ZnO), tantalum pentoxide ($Ta_2O_5$), niobium pentoxide ($Nb_2O_5$), tungsten trioxide ($WO_3$), titanium dioxide ($TiO_2$), aluminum oxide ($Al_2O_3$), zirconium dioxide ($ZrO_2$), or indium oxide ($In_2O_3$). The thickness of the heat-ray reflective film 212B is preferably 50 nm or more and 400 nm or less.

The heat-ray reflecting glass 212 may be a commercial product. The heat-ray reflecting glass 212 includes a heat-ray reflecting heat-resistant tempered glass.

The punched metal plate 214 reliably prevents microwaves radiated into the accommodation space 1A due to the drive of the microwave supply unit 33 (see FIG. 8) from leaking to the outside of the heating cooking apparatus 1 through the see-through window portion 21. Further, the punched metal plate 214 inhibits transmission of heat rays radiated from the first heater 311 (see FIG. 7) of the first air sending unit 31, the second heater 321 (see FIG. 7) of the second air sending unit 32, or the heating cooking heater unit 341 (see FIG. 8) of the grill unit 34.

The punched metal plate 214 includes a plurality of punch holes. The plurality of punch holes block the transmission of microwaves radiated from the microwave supply unit 33 (see FIG. 8). The plurality of punch holes are formed such that a user can see the accommodation space 1A of the heating cooking chamber 10. Specifically, the plurality of punch holes of the punched metal plate 214 are formed in a mesh shape. The material of the punched metal plate 214 includes a metal.

In the present embodiment, the front glass plate 211, the heat-ray reflecting glass 212, the punched metal plate 214, and the rear glass plate 213 are arranged, in this order, side by side in a line at intervals along a pull-out direction of the pull-out body 13. Accordingly, the lid portion 20 includes a heat-ray blocking space CR and a heat insulation space DR. The heat-ray blocking space CR mainly blocks the transmission of heat rays and inhibits heat transfer. The heat-ray blocking space CR indicates an enclosed space formed by the rear surface of the heat-ray reflecting glass 212, the front surface of the rear glass plate 213, and the frame portion 22. The heat insulation space DR mainly inhibits heat transfer. The heat insulation space DR indicates an enclosed space formed by the rear surface of the front glass plate 211, the front surface of the heat-ray reflecting glass 212, and the frame portion 22. The heat-ray blocking space CR is located behind the heat insulation space DR.

The temperature of air in the accommodation space 1A rises due to the drive of the first air sending unit 31, the second air sending unit 32, or the grill unit 34. Further, the first air sending unit 31, the second air sending unit 32, or the grill unit 34 radiates heat rays into the accommodation space 1A by the drive thereof. The rear glass plate 213 absorbs heat rays and generates heat. Accordingly, the rear glass plate 213 is easily to be set at high temperature due to heat transfer, convective heat transfer, or heat radiation.

In the present embodiment, the lid portion 20 includes a heat-ray blocking space CR. Air in the heat-ray blocking space CR functions as a heat insulating material. For this reason, heat of the rear glass plate 213 is hardly to be heat-transferred to the heat-ray reflecting glass 212. Further, in the present embodiment, the heat-ray reflecting glass 212 includes the heat-ray reflective film 212B. The heat-ray reflecting glass 212 is disposed such that the heat-ray reflective film 212B is on the rear side. The heat-ray reflective film 212B reflects heat rays. For this reason, heat rays hardly reach the glass substrate 212A of the heat-ray reflecting glass 212. That is, heat generated by the heat-ray reflecting glass 212 due to absorption of heat rays is inhibited. As a result, the temperature of the heat-ray reflecting glass 212 is lower than that in a case where a heat-resistant tempered glass is used instead of the heat-ray reflecting glass 212.

In the present embodiment, the lid portion 20 includes a heat insulation space DR. Air in the heat insulation space DR functions as a heat insulating material. For this reason, heat of the heat-ray reflecting glass 212 is hardly to be heat-transferred to the front glass plate 211. Further, in the present embodiment, the heat-ray reflecting glass 212 includes a heat-ray reflective film 212B. For this reason, heat rays radiated into the accommodation space 1A hardly reach the front glass plate 211. That is, heat generated by the front glass plate 211 due to absorption of heat rays is inhibited. As a result, the temperature of the front glass plate 211 is lower than that in a case where a heat-resistant tempered glass is used instead of the heat-ray reflecting glass 212. Accordingly, the heating cooking apparatus 1 can inhibit an increase in the temperature of the outer surface of the lid portion 20.

Figure 13:
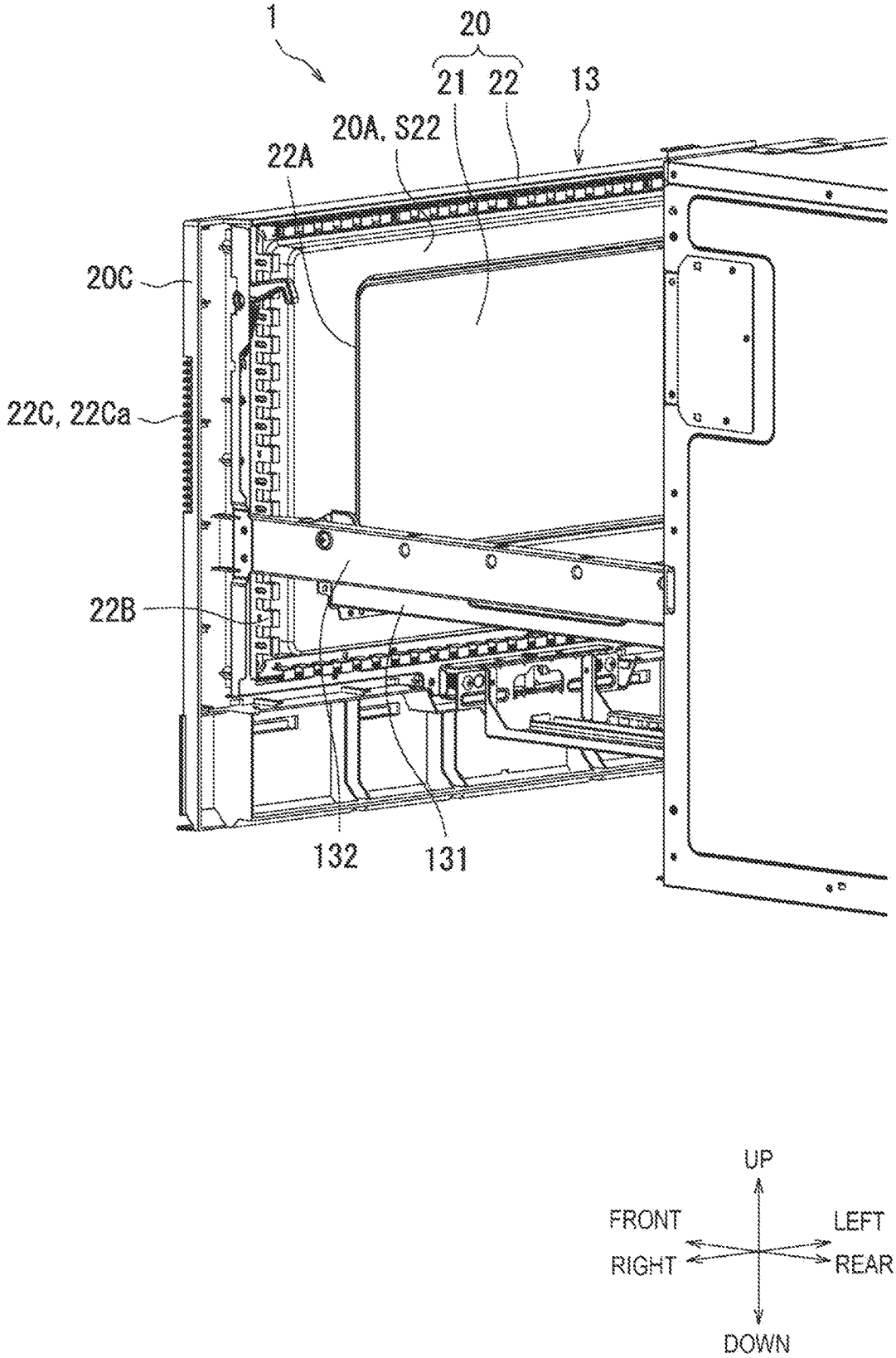
FIG. 13 is a perspective view illustrating an appearance of the heating cooking apparatus according to the embodiment of the present invention.

Next, a configuration of the frame portion 22 will be further described with reference to FIG. 1 to FIG. 13. FIG. 13 is a perspective view of the appearance of the heating cooking apparatus 1 according to the present embodiment. More specifically, FIG. 13 illustrates the appearance of the heating cooking apparatus 1 in a state where the pull-out body 13 is pulled out, as viewed in an upper right diagonal direction from behind. Further, FIG. 13 illustrates the heating cooking apparatus 1 in a state where the cover member 23 is not attached.

As illustrated in FIG. 13, the frame portion 22 of the lid portion 20 includes a choke groove 22B in addition to the opening portion 22A described with reference to FIG. 12. The choke groove 22B is formed to surround the see-through window portion 21. As illustrated in FIG. 6, the panel 11 includes a front surface 11G. The choke groove 22B faces the front surface 11G of the panel 11 in a closed state of the pull-out body 13. That is, the choke groove 22B is located outward from the opening 11A of the panel 11 in the closed state of the pull-out body 13. The material of each of the lid portion 20 and the panel 11 is a metal.

The choke groove 22B prevents generation of gaps between the front surface 11G of the panel 11 and the rear surface 20A of the lid portion 20 in the closed state of the pull-out body 13. As a result, the choke groove 22B reliably prevents microwaves radiated into the accommodation space 1A from leaking to the outside of the heating cooking apparatus 1 when the microwave supply unit 33 is driven.

Figure 14:
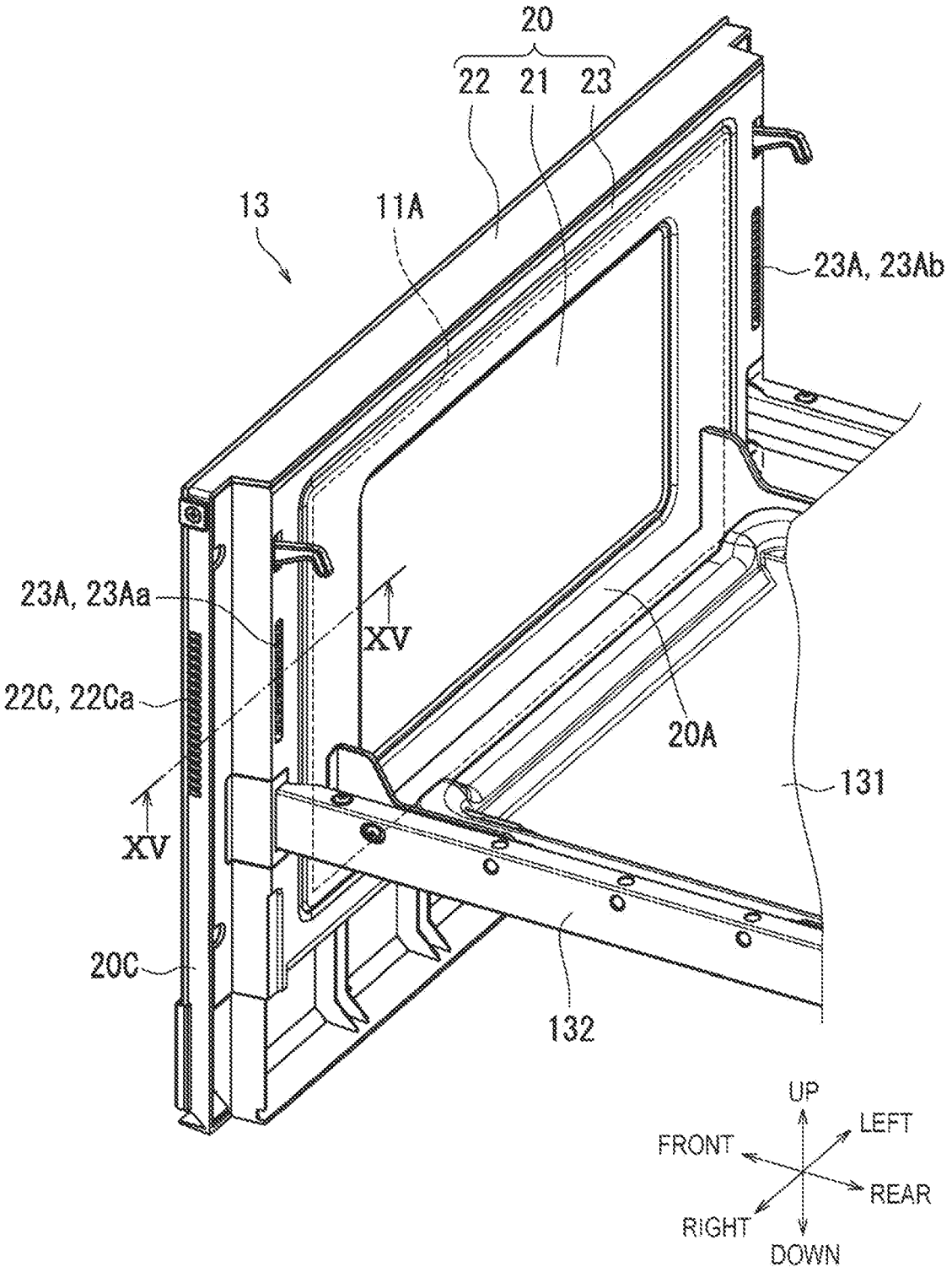
FIG. 14 is a perspective view illustrating an appearance of the heating cooking apparatus according to the embodiment of the present invention.
Figure 15:
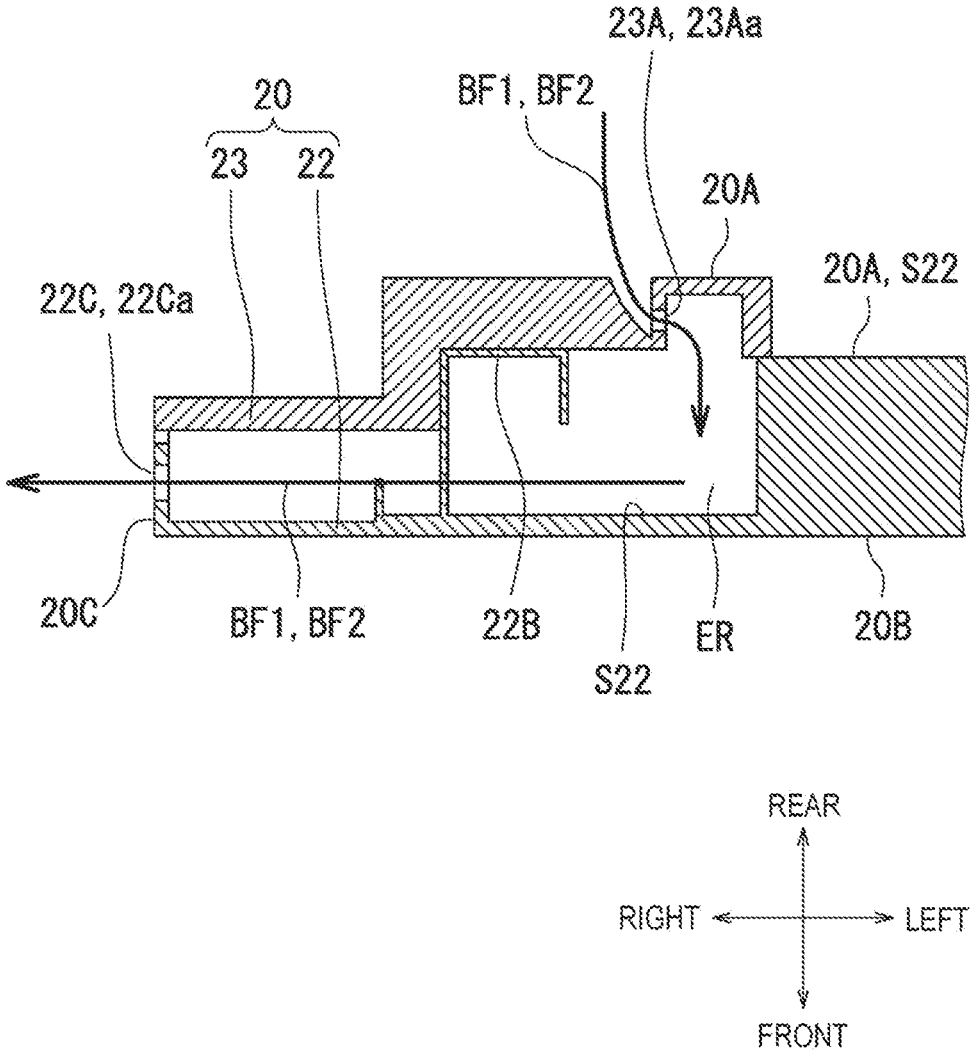
FIG. 15 is a partial cross-sectional view of a lid portion 20 along a section line XV in FIG. 14.

Next, details of the configuration of the lid portion 20 will be described with reference to FIG. 1 to FIG. 15. FIG. 14 is a perspective view of the appearance of the heating cooking apparatus 1 according to the present embodiment. More specifically, FIG. 14 illustrates the appearance of the heating cooking apparatus 1 in a state where the pull-out body 13 is pulled out, as viewed in an upper right diagonal direction from behind. In FIG. 14, a dashed line indicates an area of the rear surface 20A of the lid portion 20 that faces the opening 11A (see FIG. 6) of the panel 11 in the closed state of the pull-out body 13. FIG. 15 is a partial cross-sectional view of the lid portion 20 along a section line XV in FIG. 14.

As illustrated in FIG. 14, the lid portion 20 includes the cover member 23 in addition to the see-through window portion 21 and the frame portion 22 described with reference to FIG. 12. The cover member 23 prevents foreign particles from being infiltrated into the choke groove 22B of the lid portion 20.

The cover member 23 is a rectangular frame-shaped object. The cover member 23 covers the entire choke groove 22B of the lid portion 20. Specifically, the cover member 23 is located outward from the opening 11A of the panel 11 in the closed state of the pull-out body 13. The material of the cover member 23 is a synthetic resin. The synthetic resin includes, for example, polypropyne.

As illustrated in FIG. 14, the cover member 23 includes a pair of air supply hole portions 23A. The pair of air supply hole portions 23A guide part of the blown air flow BF to an air-cooled space ER to be described below with reference to FIG. 15 in the closed state of the pull-out body 13. The pair of air supply hole portions 23A include the right air supply hole portion 23Aa and the left air supply hole portion 23Ab. The right air supply hole portion 23Aa is located at a right portion on the back surface of the cover member 23. The right air supply hole portion 23Aa faces the right fifth through hole portion 11Fa of the panel 11 described with reference to FIG. 6 in the closed state of the pull-out body 13. The left air supply hole portion 23Ab is located at a left portion on the back surface of the cover member 23. The left air supply hole portion 23Ab faces the left fifth through hole portion 11Fb of the panel 11 described with reference to FIG. 6 in the closed state of the pull-out body 13. As illustrated in FIG. 15, the pair of air supply hole portions 23A pass through the cover member 23. The pair of air supply hole portions 23A are examples of first through hole portions.

As illustrated in FIG. 15, the cover member 23 is located on an inner surface S22 of the frame portion 22. The inner surface S22 of the frame portion 22 indicates the surface of the frame portion 22 proximate to the accommodation space 1A. When the cover member 23 is attached to the frame portion 22, the air-cooled space ER is formed between the cover member 23 and the inner surface S22 of the frame portion 22. The air-cooled space ER is formed to surround the see-through window portion 21. The air-cooled space ER communicates with the pair of air supply hole portions 23A of the cover member 23. The air-cooled space ER is an example of a second space.

As illustrated in FIG. 3 and FIG. 4, the frame portion 22 of the lid portion 20 includes a pair of exhaust hole portions 22C. As illustrated in FIG. 15, the air-cooled space ER communicates with the pair of exhaust hole portions 22C of the frame portion 22. As illustrated in FIG. 3 and FIG. 4, the pair of exhaust hole portions 22C guide air in the air-cooled space ER to the outside of the heating cooking apparatus 1. The pair of exhaust hole portions 22C include a right exhaust hole portion 22Ca and a left exhaust hole portion 22Cb. The lid portion 20 includes a right wall 20C and a left wall 20D. The right exhaust hole portion 22Ca is located at an upper portion of the right wall 20C of the lid portion 20. The right exhaust hole portion 22Ca passes through the right wall 20C of the lid portion 20. The left exhaust hole portion 22Cb is located at an upper portion of the left wall 20D of the lid portion 20. The left exhaust hole portion 22Cb passes through the left wall 20D of the lid portion 20. The pair of exhaust hole portions 22C are examples of second through hole portions.

Figure 16:
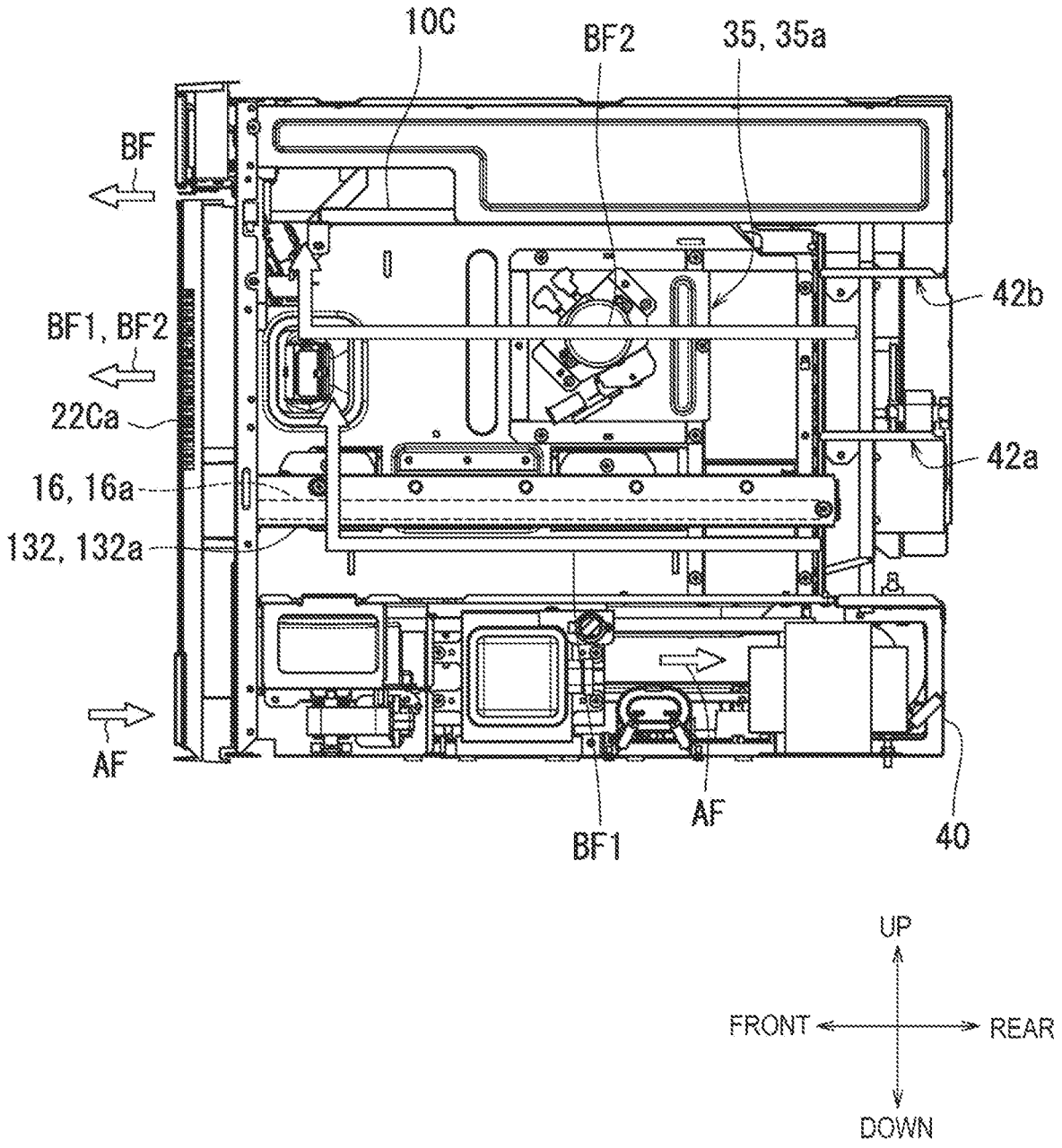
FIG. 16 is a diagram illustrating a right side surface of the heating cooking apparatus according to the embodiment of the present invention.
Figure 17:
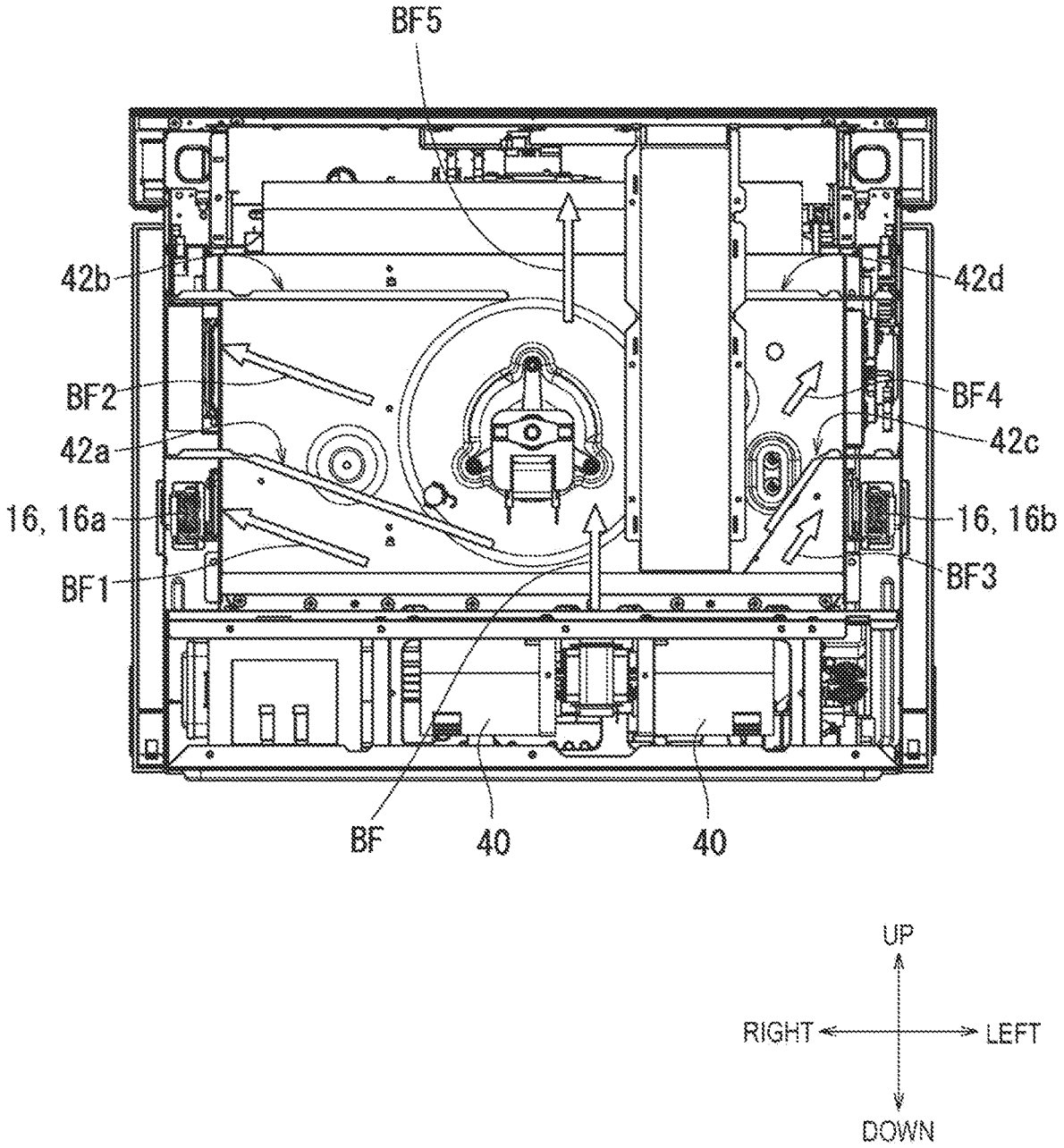
FIG. 17 is a diagram illustrating a back surface of the heating cooking apparatus according to the embodiment of the present invention.
Figure 18:
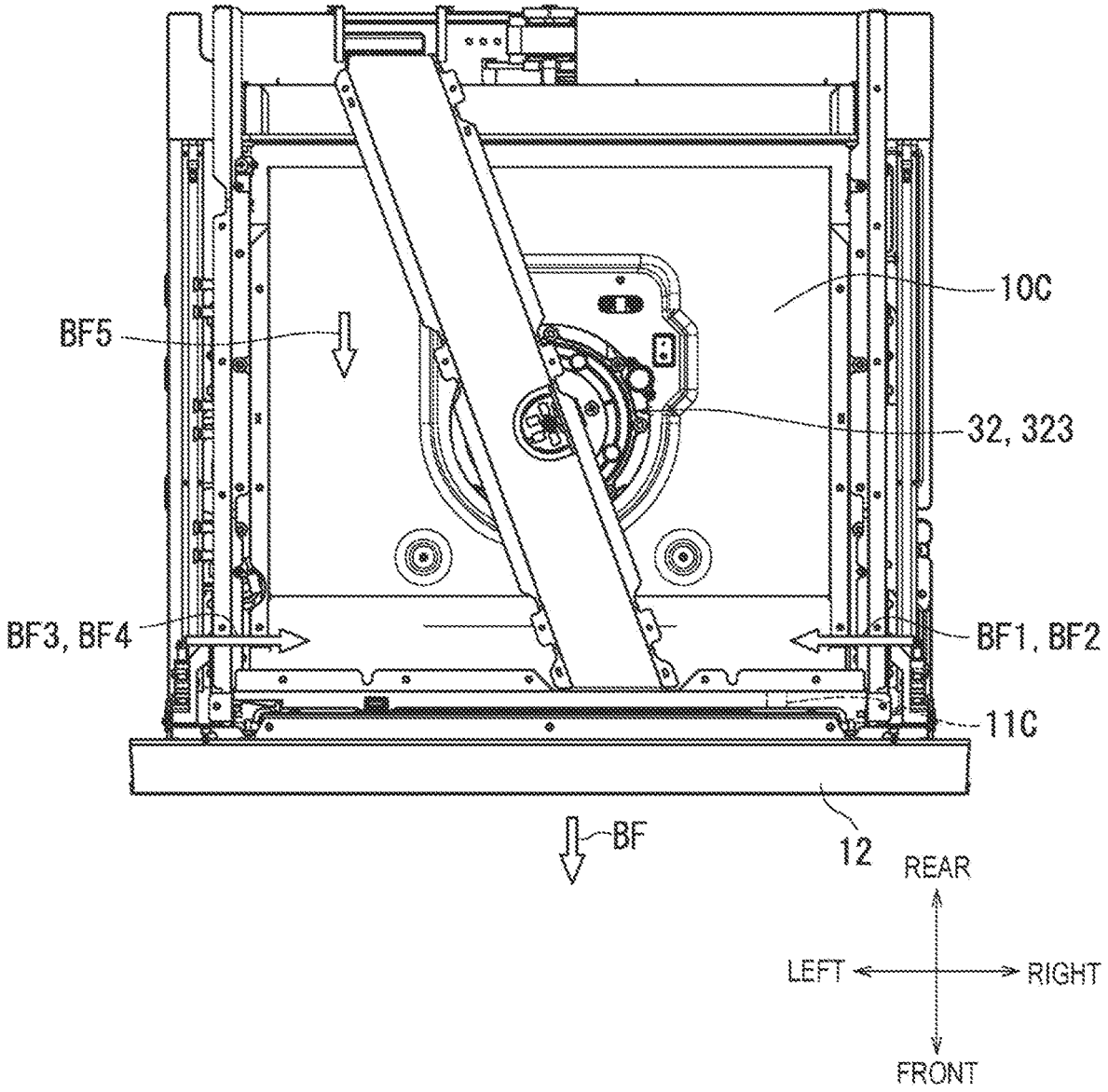
FIG. 18 is a diagram illustrating an upper surface of the heating cooking apparatus according to the embodiment of the present invention.
Figure 19:
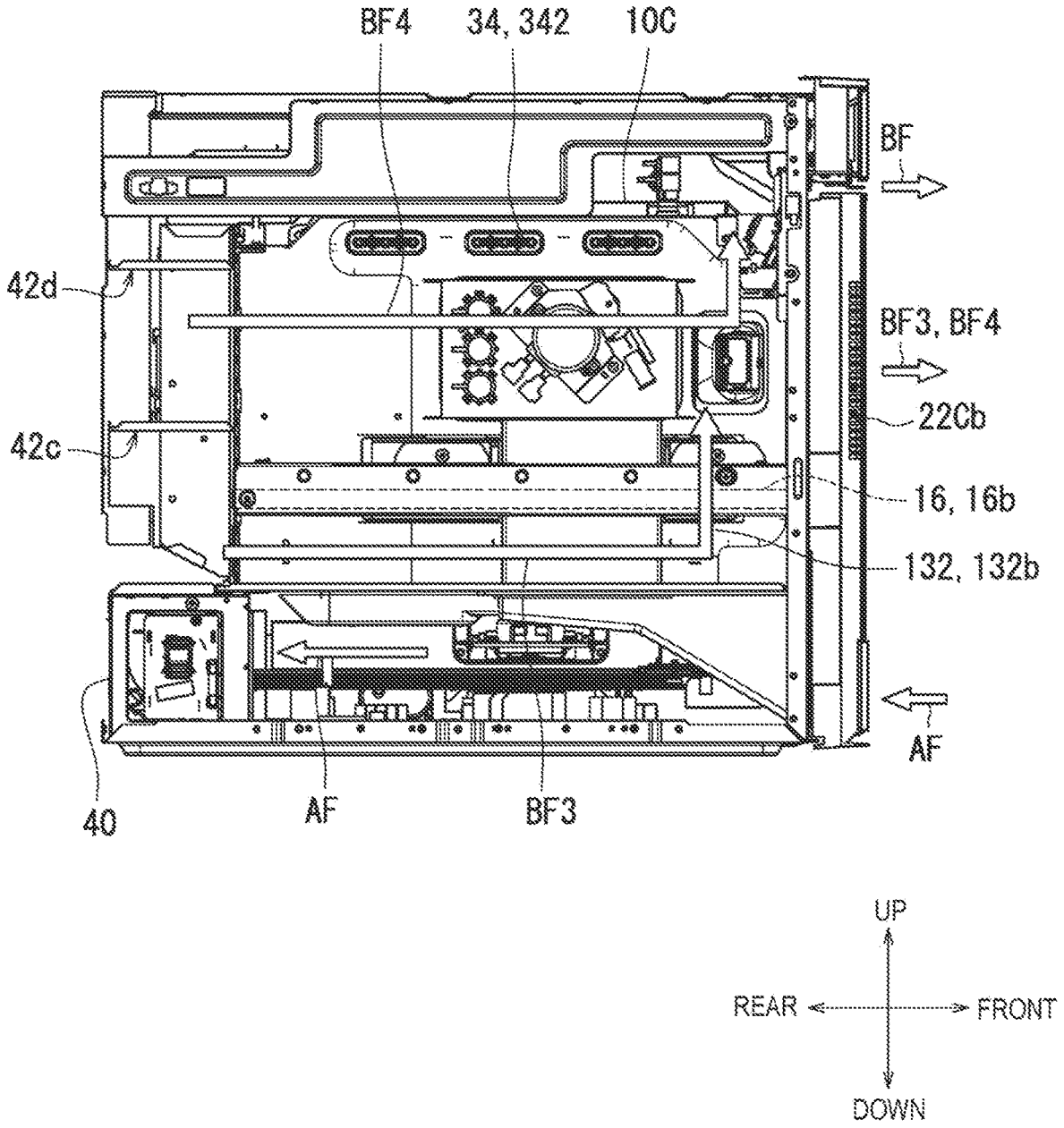
FIG. 19 is a diagram illustrating a left side surface of the heating cooking apparatus according to the embodiment of the present invention.

Next, a flow of air generated by the drive of the cooling fan 40 will be described with reference to FIG. 15 to FIG. 19. FIG. 16 is a diagram illustrating a right side surface of the heating cooking apparatus 1 according to the present embodiment. FIG. 17 is a diagram illustrating a back surface of the heating cooking apparatus 1 according to the present embodiment. FIG. 18 is a diagram illustrating an upper surface of the heating cooking apparatus 1 according to the present embodiment. FIG. 19 is a diagram illustrating a left side surface of the heating cooking apparatus 1 according to the present embodiment. Note that the housing 14 is omitted in FIG. 17 to FIG. 19.

As illustrated in FIG. 16, when the cooling fan 40 is driven, an intake air flow AF is generated. The intake air flow AF flows through the air intake space AR described with reference to FIG. 8. At this time, the intake air flow AF cools a power supply and the electrical components that are located in the air intake space AR.

When the cooling fan 40 is driven, the blown air flow BF is generated. The blown air flow BF described with reference to FIG. 8 flows through the exhaust space BR.

As illustrated in FIG. 17, the blown air flow BF is mainly branched into a first blown air flow BF1 to a fifth blown air flow BF5 by the plurality of air deflecting plates 42 described with reference to FIG. 9 and FIG. 10.

The first blown air flow BF1 is formed by the first air deflecting plate 42*a*. More specifically, the first blown air flow BF1 is formed through a process in which part of the blown air flow BF blown out upward comes into contact with the first air deflecting plate 42*a* and flows toward the right slide rail 16*a*.

As illustrated in FIG. 16, after flowing along the right slide rail 16*a*, the first blown air flow BF1 flows upward. At this time, the first blown air flow BF1 cools the right slide member 132*a*, the right slide rail 16*a*, and the like.

In addition, part of the first blown air flow BF1 flows into the right air supply hole portion 23Aa (see FIG. 14) of the cover member 23 through the right fifth through hole portion 11Fa of the panel 11 described with reference to FIG. 6. Subsequently, as illustrated in FIG. 15, the first blown air flow BF1 flows through the air-cooled space ER. The temperature of the frame portion 22 tends to become high as the temperature in the accommodation space 1A rises due to the drive of the first air sending unit 31, the second air sending unit 32, or the grill unit 34. The first blown air flow BF1 flows through the air-cooled space ER to cool the frame portion 22. The first blown air flow BF1 in the air-cooled space ER joins the second blown air flow BF2 in the air-cooled space ER. The first blown air flow BF1 and the second blown air flow BF2 having a temperature risen through heat exchange due to cooling are discharged to the outside of the heating cooking apparatus 1 through the right exhaust hole portion 22Ca of the lid portion 20.

As illustrated in FIG. 18, the first blown air flow BF1 flows toward the exhaust hole portion 11C described with reference to FIG. 6 along the upper wall 10C of the heating cooking chamber 10. At this time, the first blown air flow BF1 joins the second blown air flow BF2 to the fifth blown air flow BF5. Subsequently, the blown air flow BF having a temperature risen through heat exchange due to cooling is discharged to the outside of the heating cooking apparatus 1 through the exhaust hole portion 11C of the panel 11.

As illustrated in FIG. 17, the second blown air flow BF2 is formed by the second air deflecting plate 42*b*. Specifically, the second blown air flow BF2 is formed through a process in which part of the blown air flow BF blown out upward comes into contact with the second air deflecting plate 42*b* and flows toward the air supply damper 35*a*. As illustrated in FIG. 16, after flowing along the right wall 10A of the heating cooking chamber 10, the second blown air flow BF2 flows upward. At this time, part of the second blown air flow BF2 is supplied into the accommodation space 1A when the air supply damper 35*a* opens the air supply hole portion 10A1 of the heating cooking chamber 10.

In addition, part of the second blown air flow BF2 flows through the right air supply hole portion 23Aa (see FIG. 14) of the cover member 23 through the right fifth through hole portion 11Fa of the panel 11 described with reference to FIG. 6. Subsequently, as illustrated in FIG. 15, the second blown air flow BF2 flows through the air-cooled space ER. The second blown air flow BF2 flows through the air-cooled space ER to cool the frame portion 22. In addition, the second blown air flow BF2 in the air-cooled space ER joins the first blown air flow BF1 in the air-cooled space ER. The first blown air flow BF1 and the second blown air flow BF2 having a temperature risen through heat exchange due to cooling are discharged to the outside of the heating cooking apparatus 1 through the right exhaust hole portion 22Ca of the lid portion 20.

As illustrated in FIG. 18, the second blown air flow BF2 flows toward the exhaust hole portion 11C described with reference to FIG. 6 along the upper wall 10C of the heating cooking chamber 10. At this time, the second blown air flow BF2 joins the first blown air flow BF1 and the third blown air flow BF3 to the fifth blown air flow BF5. Subsequently, the blown air flow BF having a temperature risen through heat exchange due to cooling is discharged to the outside of the heating cooking apparatus 1 through the exhaust hole portion 11C of the panel 11.

As illustrated in FIG. 17, the third blown air flow BF3 is formed by the third air deflecting plate 42*c*. Specifically, the third blown air flow BF3 is formed through a process in which the blown air flow BF blown out upward comes into contact with the third air deflecting plate 42*c* and flows toward the left slide rail 16*b*.

As illustrated in FIG. 19, after flowing along the left slide rail 16*b*, the third blown air flow BF3 flows upward. At this time, the third blown air flow BF3 cools the left slide member 132*b*, the left slide rail 16*b*, and the like.

In addition, part of the third blown air flow BF3 flows through the left air supply hole portion 23Ab (see FIG. 14) of the cover member 23 through the left fifth through hole portion 11Fb of the panel 11 described with reference to FIG. 6. Subsequently, the third blown air flow BF3 flows through the air-cooled space ER, similarly to the first blown air flow BF1. The third blown air flow BF3 flows through the air-cooled space ER to cool the frame portion 22. In addition, the third blown air flow BF3 in the air-cooled space ER joins the fourth blown air flow BF4 in the air-cooled space ER. The third blown air flow BF3 and the fourth blown air flow BF4 having a temperature risen through heat exchange due to cooling are discharged to the outside of the heating cooking apparatus 1 through the left exhaust hole portion 22Cb of the lid portion 20 as illustrated in FIG. 19.

As illustrated in FIG. 18, the third blown air flow BF3 flows toward the exhaust hole portion 11C described with reference to FIG. 6 along the upper wall 10C of the heating cooking chamber 10. At this time, the third blown air flow BF3 joins the first blown air flow BF1, the second blown air flow BF2, the fourth blown air flow BF4, and the fifth blown air flow BF5. Subsequently, the blown air flow BF having a temperature risen through heat exchange due to cooling is discharged to the outside of the heating cooking apparatus 1 through the exhaust hole portion 11C of the panel 11.

As illustrated in FIG. 17, the fourth blown air flow BF4 is formed by the fourth air deflecting plate 42*d*. Specifically, the fourth blown air flow BF4 is formed through a process in which part of the blown air flow BF blown out upward comes into contact with the fourth air deflecting plate 42*d* and flows toward the third energization unit 342 of the grill unit 34.

As illustrated in FIG. 19, after flowing along the left wall 10B of the heating cooking chamber 10, the fourth blown air flow BF4 flows upward. At this time, the fourth blown air flow BF4 cools the third energization unit 342 of the grill unit 34, and the like.

In addition, part of the fourth blown air flow BF4 flows through the left air supply hole portion 23Ab (see FIG. 14) of the cover member 23 through the left fifth through hole portion 11Fb of the panel 11 described with reference to FIG. 6. Subsequently, the fourth blown air flow BF4 flows through the air-cooled space ER, similarly to the second blown air flow BF2. The fourth blown air flow BF4 flows through the air-cooled space ER to cool the frame portion 22. In addition, the fourth blown air flow BF4 in the air-cooled space ER joins the third blown air flow BF3 in the air-cooled space ER. The third blown air flow BF3 and the fourth blown air flow BF4 having a temperature risen through heat exchange due to cooling are discharged to the outside of the heating cooking apparatus 1 through the left exhaust hole portion 22Cb of the lid portion 20 as illustrated in FIG. 19.

As illustrated in FIG. 18, the fourth blown air flow BF4 flows toward the exhaust hole portion 11C described with reference to FIG. 6 along the upper wall 10C of the heating cooking chamber 10. At this time, the fourth blown air flow BF4 joins the first blown air flow BF1 to the third blown air flow BF3, and the fifth blown air flow BF5. Subsequently, the blown air flow BF having a temperature risen through heat exchange due to cooling is discharged to the outside of the heating cooking apparatus 1 through the exhaust hole portion 11C of the panel 11.

As illustrated in FIG. 17, the fifth blown air flow BF5 is formed by not coming into contact with the plurality of air deflecting plates 42. The fifth blown air flow BF5 flows upward along the outer surface of the rear wall 10E of the heating cooking chamber 10. Subsequently, as illustrated in FIG. 18, the fifth blown air flow BF5 flows toward the exhaust hole portion 11C described with reference to FIG. 6 along the upper wall 10C of the heating cooking chamber 10. At this time, the fifth blown air flow BF5 joins the first blown air flow BF1 to the fourth blown air flow BF4. Subsequently, the blown air flow BF having a temperature risen through heat exchange due to cooling is discharged to the outside of the heating cooking apparatus 1 through the exhaust hole portion 11C of the panel 11.

Figure 20:
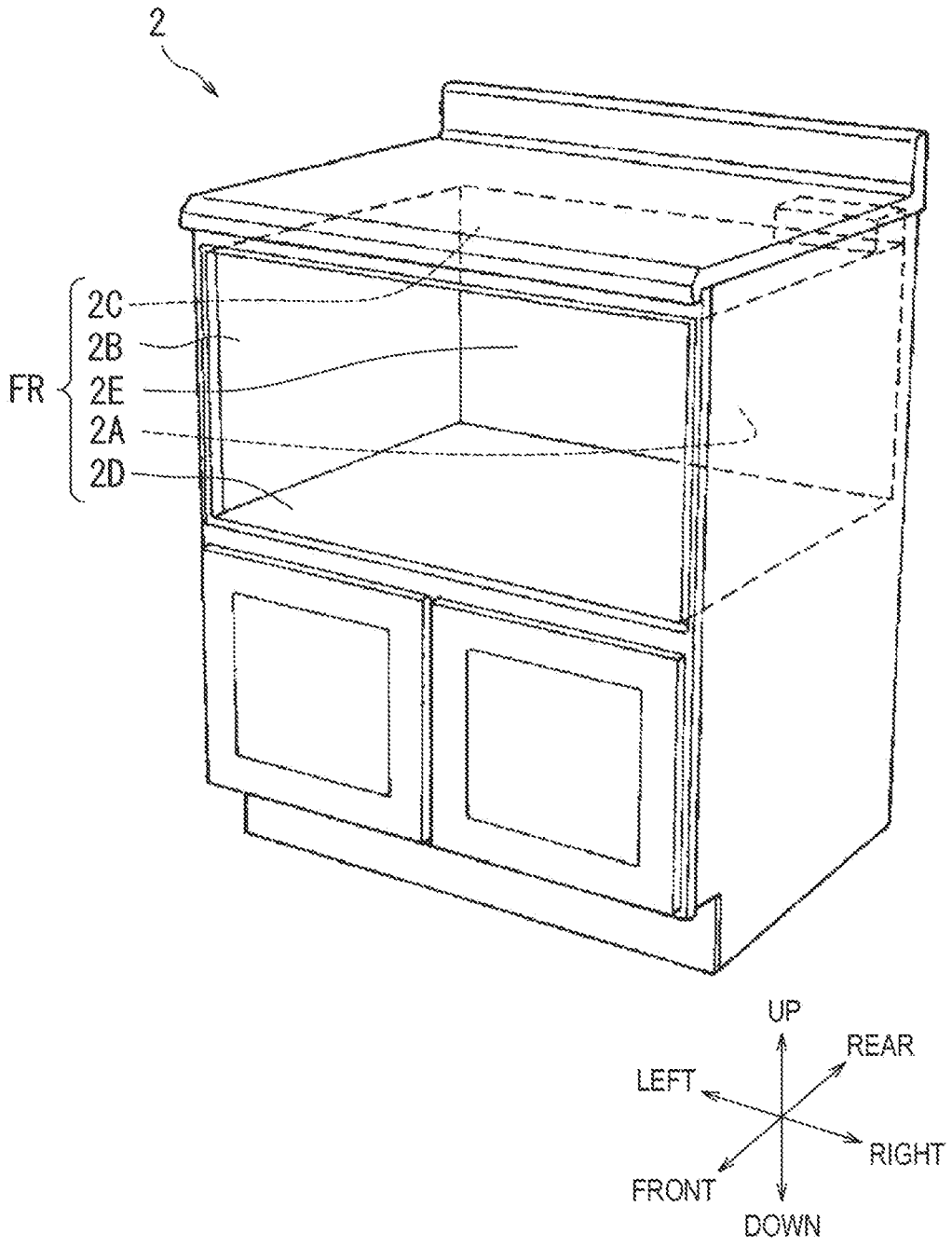
FIG. 20 is a diagram illustrating an appearance of a cabinet with the built-in heating cooking apparatus according to the embodiment of the present invention is built.

Next, a cabinet 2 with the built-in heating cooking apparatus 1 will be described with reference to FIG. 20. FIG. 20 is a diagram illustrating an external appearance of the cabinet 2 with the built-in heating cooking apparatus 1 according to the present embodiment.

The heating cooking apparatus 1 is disposed in the form of being built into the cabinet 2. As illustrated in FIG. 20, the cabinet 2 includes an accommodation space FR. The heating cooking apparatus 1 is disposed in the accommodation space FR. The accommodation space FR is a space having a rectangular parallelepiped shape. The cabinet 2 includes a right inner surface 2A, a left inner surface 2B, an upper inner surface 2C, a lower inner surface 2D, and a rear inner surface 2E. The accommodation space FR is formed by the right inner surface 2A, the left inner surface 2B, the upper inner surface 2C, the lower inner surface 2D, and the rear inner surface 2E.

As described with reference to FIG. 1 to FIG. 20, in the present embodiment, the heating cooking apparatus 1 includes the heating cooking chamber 10, the lid portion 20, the first air sending unit 31, the second air sending unit 32, and the grill unit 34. The lid portion 20 includes the see-through window portion 21. The see-through window portion 21 includes three glass plates 210. The three glass plates 210 include the heat-ray reflecting glass 212, the rear glass plate 213, and the front glass plate 211. The heat-ray reflecting glass 212 is located between the rear glass plate 213 and the front glass plate 211. The rear glass plate 213, the heat-ray reflecting glass 212, and the front glass plate 211 are arranged side by side in a line at intervals. Thereby, the see-through window portion 21 includes the heat-ray blocking space CR and the heat insulation space DR. Air in the heat-ray blocking space CR and air in the heat insulation space DR serve as a heat insulating material. Further, the heat-ray blocking space CR blocks the transmission of heat rays. Thus, heat rays are less likely to reach the front glass plate 211 than in a case where the heat-ray reflecting glass 212 is not provided. For this reason, the front glass plate 211 hardly generates heat due to the absorption of heat rays. That is, the temperature of the front glass plate 211 becomes lower than in a case where the heat-ray reflecting glass 212 is not provided. As a result, the heating cooking apparatus 1 can reduce the rise in the temperature of the outer surface of the lid portion 20. In addition, even when some of particles constituting the heat-ray reflective film 212B of the heat-ray reflecting glass 212 is peeled off, it is possible to reliably prevent the peeled-off particles from infiltrating into the accommodation space 1A.

Further, in the present embodiment, the heating cooking apparatus 1 does not rotate an object to be heated when the microwave supply unit 33 is driven. For this reason, in order to uniformly heat the object to be heated in a grill heating mode, the heating cooking heater unit 341 is to be located in a substantially center portion in the front-rear direction, as described with reference to FIG. 7. When the heating cooking heater unit 341 is located in a substantially center portion in the front-rear direction, the temperature of the outer surface of the lid portion 20 is more likely to become high than in a case where the heating cooking heater unit 341 is located at a rear portion in the front-rear direction. As a method for inhibiting the rise in the temperature of the outer surface of the lid portion 20, it is conceivable to reduce the output of the heating cooking heater unit 341. In the present embodiment, the rear glass plate 213, the heat-ray reflecting glass 212, and the front glass plate 211 are arranged side by side in a line at intervals. For this reason, the heating cooking apparatus 1 can reduce the rise in the temperature of the outer surface of the lid portion 20 even when the output of the heating cooking heater unit 341 is not reduced. For example, even when the temperature in the accommodation space 1A is approximately 240 degrees, the heating cooking apparatus 1 can maintain the temperature of the outer surface of the lid portion 20 at approximately 80 degrees.

As described with reference to FIG. 1 to FIG. 20, among the three glass plates 210, the rear glass plate 213 is located closest to the accommodation space 1A. The heat-ray reflecting glass 212 is located adjacent to the rear glass plate 213. Thus, the heat-ray blocking space CR is located adjacent to the rear glass plate 213. Thereby, the number of glass plates that generate heat due to the absorption of heat rays can be further reduced. For this reason, the temperature of the front glass plate 211 is, for example, lower than that in a case where the heat insulation space DR is located adjacent to the rear glass plate 213. As a result, the heating cooking apparatus 1 can further reduce the rise in the temperature of the outer surface of the lid portion 20.

As described with reference to FIG. 1 to FIG. 20, the heat-ray reflecting glass 212 includes the glass substrate 212A and the heat-ray reflective film 212B. The heat-ray reflective film 212B is formed on one side of the glass substrate 212A. The heat-ray reflecting glass 212 is disposed such that the heat-ray reflective film 212B is located proximate to the accommodation space 1A. Thereby, heat rays are less likely to reach the glass substrate 212A of the heat-ray reflecting glass 212 than in a case where the heat-ray reflecting glass 212 is disposed such that the heat-ray reflective film 212B is located opposite to the accommodation space 1A. For this reason, the glass substrate 212A hardly generates heat due to absorption of heat. As a result, the heating cooking apparatus 1 can further reduce the rise in the temperature of the outer surface of the lid portion 20.

As described with reference to FIG. 1 to FIG. 20, the heating cooking apparatus 1 further includes the housing 14 and the cooling fan 40. The lid portion 20 further includes the frame portion 22 and the cover member 23. The cover member 23 is located outward from the opening 11A in a state where the lid portion 20 closes the opening 11A. The cover member 23 and the inner surface S22 form the air-cooled space ER therebetween. The cover member 23 includes the pair of air supply hole portions 23A. The frame portion 22 includes the pair of exhaust hole portions 22C. Thereby, the heating cooking apparatus 1 can guide, to the air-cooled space ER, part of the blown air flow BF flowing through the outer surface of the heating cooking chamber 10 by the drive of the cooling fan 40 and discharge it to the outside of the heating cooking apparatus 1. For this reason, the heating cooking apparatus 1 can cool the lid portion 20 having a temperature risen due to the drive of the first air sending unit 31, the second air sending unit 32, or the grill unit 34. As a result, the heating cooking apparatus 1 can further reduce the rise in the temperature of the outer surface of the lid portion 20.

As described with reference to FIG. 1 to FIG. 20, the heating cooking apparatus 1 includes the grill unit 34. Thereby, the heating cooking apparatus 1 can perform heating and cooking by using radiant heat.

As described with reference to FIG. 1 to FIG. 20, the heating cooking apparatus 1 includes the first air sending unit 31 and the second air sending unit 32. Thereby, the heating cooking apparatus 1 can perform heating and cooking by using hot air. Further, the heating cooking apparatus 1 can heat and cook an object to be heated by using hot air having different heating conditions.

As described with reference to FIG. 1 to FIG. 20, the heating cooking apparatus 1 includes the microwave supply unit 33. The heating cooking apparatus 1 can perform heating and cooking by using microwaves.

As described with reference to FIG. 1 to FIG. 20, the heating cooking apparatus 1 includes the partition plate 41. The temperature of air in the exhaust space BR is higher than the temperature of air in the air intake space AR due to the temperature of the outer surface of the heating cooking chamber 10, or the like. The partition plate 41 can more reliably prevent air in the air intake space AR and air in the exhaust space BR from being mixed together. Owing to this configuration, the heating cooking apparatus 1 can more easily blow out low-temperature air into the exhaust space BR. As a result, the heating cooking apparatus 1 can efficiently cool the components to be cooled.

As described with reference to FIG. 1 to FIG. 20, the panel 11 includes the opening 11A. As illustrated in FIG. 6, the air intake hole portion 11BA and the exhaust hole portion 11C are disposed to interpose the opening 11A therebetween. Thereby, the high-temperature air discharged through the exhaust hole portion 11C is less likely to be taken in through the air intake hole portion 11BA. As a result, the heating cooking apparatus 1 can efficiently cool the components to be cooled.

As described with reference to FIG. 1 to FIG. 20, the air intake hole portion 11BA is disposed below the opening 11A. The exhaust hole portion 11C is disposed above the opening 11A. The high-temperature air more easily rises than the low-temperature air. For this reason, the high-temperature air discharged through the exhaust hole portion 11C is less likely to be taken in through the air intake hole portion 11BA. As a result, the heating cooking apparatus 1 can more efficiently cool the components to be cooled. Further, the heating cooking apparatus 1 can efficiently inhibit the temperature rise of the components to be cooled even when there is no space for disposing the air intake hole portion 11BA and the exhaust hole portion 11C on the right and the left of the opening 11A.

As described with reference to FIG. 1 to FIG. 20, the cooling fan 40 is located at the same height as the air intake hole portion 11BA. Thereby, the cooling fan 40 can more easily take in air through the air intake hole portion 11BA as compared to a case where the cooling fan 40 is not disposed at the same height as the air intake hole portion 11BA. As a result, the heating cooking apparatus 1 can more efficiently cool the components to be cooled.

As described with reference to FIG. 1 to FIG. 20, the cooling fan 40 is located behind the heating cooking chamber 10. Thereby, the cooling fan 40 can blow out air from the rear of the heating cooking chamber 10. Thereby, the heating cooking apparatus 1 can more easily guide the blown air flow BF to each of the components to be cooled. As a result, the heating cooking apparatus 1 can more efficiently cool the components to be cooled.

As described with reference to FIG. 1 to FIG. 20, the cooling fan 40 includes a cross-flow fan. The cross-flow fan can take in air over a wide range in the left-right direction (horizontal direction) compared to a centrifugal blower. Thus, the heating cooking apparatus 1 can efficiently take in air through the air intake hole portion 11BA and can more efficiently cool the components to be cooled. The centrifugal blower includes a sirocco fan.

In the above, the embodiments of the present invention have been described with reference to the drawings (FIG. 1 to FIG. 20). Note that the present invention is not limited to the embodiment described above and can be implemented in various modes within the scope not departing from the gist of the present invention (for example, (1) to (8) described below). The drawings primarily schematically illustrate each of the constituent elements for the sake of easier understanding, and the thickness, length, quantity, and the like of each of the illustrated constituent elements are different from the actual thickness, length, quantity, and the like by reason of creation of the drawings. Further, the material, shape, dimensions, and the like of each of the constituent elements illustrated in the embodiment described above are merely examples and are not particularly limited, and various modifications can be made within the scope not substantially departing from the effects of the present invention.

(1) As described with reference to FIG. 1 to FIG. 20, in the present embodiment, the see-through window portion 21 of the lid portion 20 includes three glass plates 210, but the present invention is not limited thereto. For example, the see-through window portion 21 may include four or more glass plates. Specifically, the see-through window portion 21 may include a configuration including one or more heat-resistant tempered glasses in at least one of a first gap or a second gap. The first gap indicates a gap between the front glass plate 211 and the heat-ray reflecting glass 212. The second gap indicates a gap between the rear glass plate 213 and the heat-ray reflecting glass 212. The heat-resistant tempered glass includes the heat-ray reflecting glass 212, a float heat-resistant tempered glass, a laminated glass, or an insulating glass.

(2) As described with reference to FIG. 1 to FIG. 20, in the present embodiment, the heat-ray reflecting glass 212 is located adjacent to the rear glass plate 213, but the present invention is not limited thereto. For example, in a case where the see-through window portion 21 includes four or more glass plates, the heat-ray reflecting glass 212 may not be located adjacent to the rear glass plate 213.

(3) As described with reference to FIG. 1 to FIG. 20, in the present embodiment, the heat-ray reflecting glass 212 includes the glass substrate 212A and the heat-ray reflective film 212B formed on one side of the glass substrate 212A, but the present invention is not limited thereto. The heat-ray reflecting glass 212 may include a configuration including the glass substrate 212A and the heat-ray reflective film 212B formed on both sides of the glass substrate 212A.

(4) As described with reference to FIG. 1 to FIG. 20, in the present embodiment, the lid portion 20 includes the cover member 23, but the present invention is not limited thereto. The lid portion 20 may not include the cover member 23.

(5) As described with reference to FIG. 1 to FIG. 20, in the present embodiment, the heating cooking apparatus 1 includes the pull-out body 13, but the present invention is not limited thereto. The heating cooking apparatus 1 may not include the pull-out body 13. In this case, the heating cooking apparatus 1 may include a rotating door configured to open and close the opening 11A. For example, the rotating door is rotatable relative to the heating cooking chamber 10 with a lower side of the rotating door as an axis.

(6) As described with reference to FIG. 1 to FIG. 20, in the present embodiment, the heating cooking apparatus 1 includes the first air sending unit 31, the second air sending unit 32, and the grill unit 34, but the present invention is not limited thereto. For example, the heating cooking apparatus 1 may include one or two of the first air sending unit 31, the second air sending unit 32, and the grill unit 34.

(7) As described with reference to FIG. 1 to FIG. 20, in the present embodiment, the heating cooking apparatus 1 includes the microwave supply unit 33, but the present invention is not limited thereto. The heating cooking apparatus 1 may not include the microwave supply unit 33.

(8) As described with reference to FIG. 1 to FIG. 20, in the present embodiment, a cross-flow fan is used as the cooling fan 40, but the present invention is not limited thereto. For example, as the cooling fan 40, a centrifugal fan may be used, or a compressor may be used. In addition, in the present embodiment, as the cooling fan 40, two cross-flow fans are used, but the present invention is not limited thereto. For example, as the cooling fan 40, only one cross-flow fan may be used, or three or more cross-flow fans may be used.

INDUSTRIAL APPLICABILITY

The present invention is useful in the field of a heating cooking apparatus, for example.

REFERENCE SIGNS LIST

1 Heating cooking apparatus
1A Accommodation space
10 Heating cooking chamber
11A Opening
14 Housing
20 Lid portion
21 See-through window portion
210 Three glass plates
211 Front glass plate
212 Heat-ray reflecting glass
213 Rear glass plate
31 First air sending unit
32 Second air sending unit
34 Grill unit

The invention claimed is:

1. A pull-out heating cooking apparatus comprising:
a heating cooking chamber including an accommodation space, where an object to be heated is accommodated, and an opening communicating with the accommodation space;
a lid portion configured to close the opening;
a heat supplier configured to supply heat into the accommodation space;
a pull-out body that is pulled out freely relative to the accommodation space;
a housing configured to accommodate the heating cooking chamber;
a fan disposed in a first space formed between the heating cooking chamber and the housing; and
a pair of slide rails slidably supporting the pull-out body, wherein:
the pull-out body includes the lid portion,
the lid portion includes a see-through window portion configured to make the accommodation space visible,
the see-through window portion includes at least three glass plates comprising:
a heat-ray reflecting glass configured to reflect heat rays,
a first glass plate located proximate to the accommodation space, and
a second glass plate located opposite the accommodation space, the first space includes:
a first air deflecting plate configured to guide a part of a blown air flow, blown out by the fan, to a first slide rail of the pair of slide rails, and
a second air deflecting plate configured to guide another part of the blown air flow to a second slide rail of the pair of slide rails,
the first air deflecting plate and the second air deflecting plate protrude from an outer surface of a rear wall of the heating cooking chamber,
the lid portion further includes:
a frame portion supporting the see-through window portion, and
a cover member located on an inner surface of the frame portion, the inner surface being located proximate to the accommodation space of the frame portion, wherein:
the cover member is located outward from the opening in a state where the lid portion closes the opening,
the cover member forms a second space between the cover member and the inner surface,
the cover member includes:
a first air supply hole portion configured to guide, to the second space, the part of the blown air flow guided to the first slide rail of the pair of slide rails, and
a second air supply hole portion configured to guide, to the second space, the other part of the blown air flow guided to the second slide rail of the pair of slide rail, and
the frame portion includes a through hole portion configured to guide air in the second space to outside the heating cooking apparatus.

2. The pull-out heating cooking apparatus according to claim 1,
wherein, among the at least three glass plates, the first glass plate is located closest to the accommodation space, and
the heat-ray reflecting glass is located adjacent to the first glass plate.

3. The pull-out heating cooking apparatus according to claim 1,
wherein the at least three glass plates are arranged side by side in a line at intervals along a pull-out direction of the pull-out body.

4. The pull-out heating cooking apparatus according to claim 1,
wherein the heat-ray reflecting glass includes:
a glass substrate, and
a heat-ray reflective film formed on one side of the glass substrate,
the heat-ray reflective film reflects the heat rays, and
the heat-ray reflecting glass is disposed, such that the heat-ray reflective film of the heat-ray reflecting glass is located proximate to the accommodation space.

5. The pull-out heating cooking apparatus according to claim 1,
wherein the heat supplier includes a grill unit configured to supply heat radiation into the accommodation space.

6. The pull-out heating cooking apparatus according to claim 1,
wherein the heat supplier includes an air sending unit configured to supply hot air into the accommodation space.

7. The pull-out heating cooking apparatus according to claim 6,
wherein the air sending unit includes a first air sending unit and a second air sending unit.

8. The pull-out heating cooking apparatus according to claim 1, further comprising:
a microwave supplier configured to supply a microwave into the accommodation space.

* * * * *